US009590287B2

(12) United States Patent
Burris et al.

(10) Patent No.: US 9,590,287 B2
(45) Date of Patent: Mar. 7, 2017

(54) SURGE PROTECTED COAXIAL TERMINATION

(71) Applicant: Corning Optical Communications RF LLC, Glendale, AZ (US)

(72) Inventors: Donald Andrew Burris, Peoria, AZ (US); Guy Joachin Castonguay, Peoria, AZ (US); Thomas Dewey Miller, Peoria, AZ (US)

(73) Assignee: Corning Optical Communications RF LLC, Glendale, AZ (US)

( * ) Notice: Subject to any disclaimer, the term of this patent is extended or adjusted under 35 U.S.C. 154(b) by 0 days.

(21) Appl. No.: 14/795,367

(22) Filed: Jul. 9, 2015

(65) Prior Publication Data

US 2016/0248176 A1 Aug. 25, 2016

Related U.S. Application Data

(60) Provisional application No. 62/118,684, filed on Feb. 20, 2015.

(51) Int. Cl.

| | |
|---|---|
| ***H01R 9/05*** | (2006.01) |
| ***H01P 1/26*** | (2006.01) |
| ***H01R 24/48*** | (2011.01) |
| ***H01T 4/08*** | (2006.01) |
| ***H01T 4/10*** | (2006.01) |
| *H01R 103/00* | (2006.01) |

(52) U.S. Cl.

CPC ..... *H01P 1/266* (2013.01); *H01R 24/48* (2013.01); *H01T 4/08* (2013.01); *H01T 4/10* (2013.01); *H01R 2103/00* (2013.01)

(58) Field of Classification Search

CPC ..... H01R 24/48
USPC ..... 439/578, 733.1
See application file for complete search history.

(56) References Cited

U.S. PATENT DOCUMENTS

| | | | |
|---|---|---|---|
| 331,169 | A | 11/1885 | Thomas |
| 346,958 | A | 8/1886 | Stone |
| 459,951 | A | 9/1891 | Warner |

(Continued)

FOREIGN PATENT DOCUMENTS

| | | |
|---|---|---|
| CA | 2096710 | 11/1994 |
| CN | 201149936 | 11/2008 |

(Continued)

OTHER PUBLICATIONS

Office Action dated Mar. 10, 2016 pertaining to U.S. Appl. No. 14/166,653.

(Continued)

*Primary Examiner* — Tho D Ta

(57) ABSTRACT

A surge-protected coaxial termination includes a metallic outer body, a center conductor extending through a central bore of the outer body, and a spark gap created therebetween to discharge high-voltage power surges. A plurality of dielectric insulators surrounds the center conductor on opposite sides of the spark gap. High impedance inductive zones surround the spark gap to form a T-network low pass filter that nullifies the additional capacitance of the spark gap. An enlarged portion of a center conductor mitigates deleterious effects of arcing. An axial, carbon composition resistor is disposed inside the outer body, and inside the dielectric insulator to absorb the RF signal, and prevent its reflection.

23 Claims, 6 Drawing Sheets

(56) References Cited

U.S. PATENT DOCUMENTS

| | | | |
|---|---|---|---|
| 589,216 | A | 8/1897 | McKee |
| 1,371,742 | A | 3/1921 | Dringman |
| 1,488,175 | A | 3/1924 | Strandell |
| 1,667,485 | A | 4/1928 | MacDonald |
| 1,766,869 | A | 6/1930 | Austin |
| 1,801,999 | A | 4/1931 | Bowman |
| 1,885,761 | A | 11/1932 | Peirce, Jr. |
| 1,959,302 | A | 5/1934 | Paige |
| 2,013,526 | A | 9/1935 | Schmitt |
| 2,059,920 | A | 11/1936 | Weatherhead, Jr. |
| 2,102,495 | A | 12/1937 | England |
| 2,258,528 | A | 10/1941 | Wurzburger |
| 2,258,737 | A | 10/1941 | Browne |
| 2,325,549 | A | 7/1943 | Ryzowitz |
| 2,480,963 | A | 9/1949 | Quinn |
| 2,544,654 | A | 3/1951 | Brown |
| 2,549,647 | A | 4/1951 | Turenne |
| 2,694,187 | A | 11/1954 | Nash |
| 2,705,652 | A | 4/1955 | Kaiser |
| 2,743,505 | A | 5/1956 | Hill |
| 2,754,487 | A | 7/1956 | Carr et al. |
| 2,755,331 | A | 7/1956 | Melcher |
| 2,757,351 | A | 7/1956 | Klostermann |
| 2,762,025 | A | 9/1956 | Melcher |
| 2,785,384 | A | 3/1957 | Wickesser |
| 2,805,399 | A | 9/1957 | Leeper |
| 2,816,949 | A | 12/1957 | Curtiss |
| 2,870,420 | A | 1/1959 | Malek |
| 2,878,039 | A | 3/1959 | Hoegee et al. |
| 2,881,406 | A | 4/1959 | Arson |
| 2,963,536 | A | 12/1960 | Kokalas |
| 3,001,169 | A | 9/1961 | Blonder |
| 3,015,794 | A | 1/1962 | Kishbaugh |
| 3,051,925 | A | 8/1962 | Felts |
| 3,091,748 | A | 5/1963 | Takes et al. |
| 3,094,364 | A | 6/1963 | Lingg |
| 3,103,548 | A | 9/1963 | Concelman |
| 3,106,548 | A | 10/1963 | Lavalou |
| 3,140,106 | A | 7/1964 | Thomas et al. |
| 3,161,451 | A | 12/1964 | Neidecker |
| 3,184,706 | A | 5/1965 | Atkins |
| 3,193,309 | A | 7/1965 | Morris |
| 3,194,292 | A | 7/1965 | Borowsky |
| 3,196,382 | A | 7/1965 | Morello, Jr. |
| 3,206,540 | A | 9/1965 | Cohen |
| 3,245,027 | A | 4/1966 | Ziegler, Jr. |
| 3,275,913 | A | 9/1966 | Blanchard et al. |
| 3,278,890 | A | 10/1966 | Cooney |
| 3,281,756 | A | 10/1966 | O'Keefe et al. |
| 3,281,757 | A | 10/1966 | Bonhomme |
| 3,290,069 | A | 12/1966 | Davis |
| 3,292,136 | A | 12/1966 | Somerset |
| 3,320,575 | A | 5/1967 | Brown et al. |
| 3,321,732 | A | 5/1967 | Forney, Jr. |
| 3,336,563 | A | 8/1967 | Hyslop |
| 3,348,186 | A | 10/1967 | Rosen |
| 3,350,667 | A | 10/1967 | Shreve |
| 3,350,677 | A | 10/1967 | Daum |
| 3,355,698 | A | 11/1967 | Keller |
| 3,372,364 | A | 3/1968 | O'Keefe et al. |
| 3,373,243 | A | 3/1968 | Janowiak et al. |
| 3,390,374 | A | 6/1968 | Forney, Jr. |
| 3,406,373 | A | 10/1968 | Forney, Jr. |
| 3,430,184 | A | 2/1969 | Acord |
| 3,448,430 | A | 6/1969 | Kelly |
| 3,453,376 | A | 7/1969 | Ziegler, Jr. et al. |
| 3,465,281 | A | 9/1969 | Florer |
| 3,475,545 | A | 10/1969 | Stark et al. |
| 3,494,400 | A | 2/1970 | McCoy et al. |
| 3,498,647 | A | 3/1970 | Schroder |
| 3,499,671 | A | 3/1970 | Osborne |
| 3,501,737 | A | 3/1970 | Harris et al. |
| 3,517,373 | A | 6/1970 | Jamon |
| 3,526,871 | A | 9/1970 | Hobart |
| 3,533,051 | A | 10/1970 | Ziegler, Jr. |
| 3,537,065 | A | 10/1970 | Winston |
| 3,544,705 | A | 12/1970 | Winston |
| 3,551,882 | A | 12/1970 | O'Keefe |
| 3,564,487 | A | 2/1971 | Upstone et al. |
| 3,587,033 | A | 6/1971 | Brorein et al. |
| 3,596,933 | A | 8/1971 | Luckenbill |
| 3,601,776 | A | 8/1971 | Curl |
| 3,603,912 | A | 9/1971 | Kelly |
| 3,614,711 | A | 10/1971 | Anderson et al. |
| 3,622,952 | A | 11/1971 | Hilbert |
| 3,629,792 | A | 12/1971 | Dorrell |
| 3,633,150 | A | 1/1972 | Schwartz |
| 3,646,502 | A | 2/1972 | Hutter et al. |
| 3,663,926 | A | 5/1972 | Brandt |
| 3,665,371 | A | 5/1972 | Cripps |
| 3,668,612 | A | 6/1972 | Nepovim |
| 3,669,472 | A | 6/1972 | Nadsady |
| 3,671,922 | A | 6/1972 | Zerlin et al. |
| 3,671,926 | A | 6/1972 | Nepovim |
| 3,678,444 | A | 7/1972 | Stevens et al. |
| 3,678,445 | A | 7/1972 | Brancaleone |
| 3,680,034 | A | 7/1972 | Chow et al. |
| 3,681,739 | A | 8/1972 | Kornick |
| 3,683,320 | A | 8/1972 | Woods et al. |
| 3,686,623 | A | 8/1972 | Nijman |
| 3,694,792 | A | 9/1972 | Wallo |
| 3,694,793 | A | 9/1972 | Concelman |
| 3,697,930 | A | 10/1972 | Shirey |
| 3,706,958 | A | 12/1972 | Blanchenot |
| 3,708,186 | A | 1/1973 | Takagi et al. |
| 3,710,005 | A | 1/1973 | French |
| 3,739,076 | A | 6/1973 | Schwartz |
| 3,744,007 | A | 7/1973 | Horak |
| 3,744,011 | A | 7/1973 | Blanchenot |
| 3,761,870 | A | 9/1973 | Drezin et al. |
| 3,778,535 | A | 12/1973 | Forney, Jr. |
| 3,781,762 | A | 12/1973 | Quackenbush |
| 3,781,898 | A | 12/1973 | Holloway |
| 3,783,178 | A | 1/1974 | Philibert et al. |
| 3,787,796 | A | 1/1974 | Barr |
| 3,793,610 | A | 2/1974 | Brishka |
| 3,798,589 | A | 3/1974 | Deardurff |
| 3,808,580 | A | 4/1974 | Johnson |
| 3,810,076 | A | 5/1974 | Hutter |
| 3,824,026 | A | 7/1974 | Gaskins |
| 3,835,443 | A | 9/1974 | Arnold et al. |
| 3,836,700 | A | 9/1974 | Niemeyer |
| 3,845,453 | A | 10/1974 | Hemmer |
| 3,846,738 | A | 11/1974 | Nepovim |
| 3,847,463 | A | 11/1974 | Hayward et al. |
| 3,854,003 | A | 12/1974 | Duret |
| 3,854,789 | A | 12/1974 | Kaplan |
| 3,858,156 | A | 12/1974 | Zarro |
| 3,879,102 | A | 4/1975 | Horak |
| 3,886,301 | A | 5/1975 | Cronin et al. |
| 3,907,335 | A | 9/1975 | Burge et al. |
| 3,907,399 | A | 9/1975 | Spinner |
| 3,910,673 | A | 10/1975 | Stokes |
| 3,915,539 | A | 10/1975 | Collins |
| 3,936,132 | A | 2/1976 | Hutter |
| 3,937,547 | A | 2/1976 | Lee-Kemp |
| 3,953,097 | A | 4/1976 | Graham |
| 3,960,428 | A | 6/1976 | Naus et al. |
| 3,963,320 | A | 6/1976 | Spinner |
| 3,963,321 | A | 6/1976 | Burger et al. |
| 3,970,355 | A | 7/1976 | Pitschi |
| 3,972,013 | A | 7/1976 | Shapiro |
| 3,976,352 | A | 8/1976 | Spinner |
| 3,980,805 | A | 9/1976 | Lipari |
| 3,985,418 | A | 10/1976 | Spinner |
| 3,986,736 | A | 10/1976 | Takagi et al. |
| 4,012,105 | A | 3/1977 | Biddle |
| 4,017,139 | A | 4/1977 | Nelson |
| 4,022,966 | A | 5/1977 | Gajajiva |
| 4,030,742 | A | 6/1977 | Eidelberg et al. |
| 4,030,798 | A | 6/1977 | Paoli |
| 4,032,177 | A | 6/1977 | Anderson |
| 4,045,706 | A | 8/1977 | Daffner et al. |
| 4,046,451 | A | 9/1977 | Juds et al. |

(56) References Cited

U.S. PATENT DOCUMENTS

| | | | |
|---|---|---|---|
| 4,053,200 | A | 10/1977 | Pugner |
| 4,056,043 | A | 11/1977 | Sriramamurty et al. |
| 4,059,330 | A | 11/1977 | Shirey |
| 4,079,343 | A | 3/1978 | Nijman |
| 4,082,404 | A | 4/1978 | Flatt |
| 4,090,028 | A | 5/1978 | Vontobel |
| 4,093,335 | A | 6/1978 | Schwartz et al. |
| 4,100,943 | A | 7/1978 | Terada et al. |
| 4,106,839 | A | 8/1978 | Cooper |
| 4,109,126 | A | 8/1978 | Halbeck |
| 4,118,097 | A | 10/1978 | Budnick |
| 4,125,308 | A | 11/1978 | Schilling |
| 4,126,372 | A | 11/1978 | Hashimoto et al. |
| 4,131,332 | A | 12/1978 | Hogendobler et al. |
| 4,136,897 | A | 1/1979 | Haluch |
| 4,150,250 | A | 4/1979 | Lundeberg |
| 4,153,320 | A | 5/1979 | Townshend |
| 4,156,554 | A | 5/1979 | Aujla |
| 4,165,911 | A | 8/1979 | Laudig |
| 4,168,921 | A | 9/1979 | Blanchard |
| 4,173,385 | A | 11/1979 | Fenn et al. |
| 4,174,875 | A | 11/1979 | Wilson et al. |
| 4,187,481 | A | 2/1980 | Boutros |
| 4,193,655 | A | 3/1980 | Herrmann, Jr. |
| 4,194,338 | A | 3/1980 | Trafton |
| 4,197,628 | A | 4/1980 | Conti et al. |
| 4,206,963 | A | 6/1980 | English et al. |
| 4,212,487 | A | 7/1980 | Jones et al. |
| 4,225,162 | A | 9/1980 | Dola |
| 4,227,765 | A | 10/1980 | Neumann et al. |
| 4,229,714 | A | 10/1980 | Yu |
| 4,239,318 | A | 12/1980 | Schwartz |
| 4,250,348 | A | 2/1981 | Kitagawa |
| 4,260,212 | A | 4/1981 | Ritchie |
| 4,273,405 | A | 6/1981 | Law |
| 4,280,749 | A | 7/1981 | Hemmer |
| 4,285,564 | A | 8/1981 | Spinner |
| 4,290,663 | A | 9/1981 | Fowler et al. |
| 4,296,986 | A | 10/1981 | Herrmann, Jr. |
| 4,307,926 | A | 12/1981 | Smith |
| 4,309,050 | A | 1/1982 | Legris |
| 4,310,211 | A | 1/1982 | Bunnell et al. |
| 4,322,121 | A | 3/1982 | Riches et al. |
| 4,326,768 | A | 4/1982 | Punako |
| 4,326,769 | A | 4/1982 | Dorsey et al. |
| 4,334,730 | A | 6/1982 | Colwell et al. |
| 4,339,166 | A | 7/1982 | Dayton |
| 4,345,375 | A | 8/1982 | Hayward |
| 4,346,958 | A | 8/1982 | Blanchard |
| 4,354,721 | A | 10/1982 | Luzzi |
| 4,358,174 | A | 11/1982 | Dreyer |
| 4,373,767 | A | 2/1983 | Cairns |
| 4,389,081 | A | 6/1983 | Gallusser et al. |
| 4,400,050 | A | 8/1983 | Hayward |
| 4,407,529 | A | 10/1983 | Holman |
| 4,408,821 | A | 10/1983 | Forney, Jr. |
| 4,408,822 | A | 10/1983 | Nikitas |
| 4,412,717 | A | 11/1983 | Monroe |
| 4,421,377 | A | 12/1983 | Spinner |
| 4,426,127 | A | 1/1984 | Kubota |
| 4,428,639 | A | 1/1984 | Hillis |
| 4,444,453 | A | 4/1984 | Kirby et al. |
| 4,447,107 | A | 5/1984 | Major et al. |
| 4,452,503 | A | 6/1984 | Forney, Jr. |
| 4,456,323 | A | 6/1984 | Pitcher et al. |
| 4,459,881 | A | 7/1984 | Hughes, Jr. |
| 4,462,653 | A | 7/1984 | Flederbach et al. |
| 4,464,000 | A | 8/1984 | Werth et al. |
| 4,464,001 | A | 8/1984 | Collins |
| 4,469,386 | A | 9/1984 | Ackerman |
| 4,470,657 | A | 9/1984 | Deacon |
| 4,477,132 | A | 10/1984 | Moser et al. |
| 4,484,792 | A | 11/1984 | Tengler et al. |
| 4,484,796 | A | 11/1984 | Sato et al. |
| 4,490,576 | A | 12/1984 | Bolante et al. |
| 4,491,685 | A | 1/1985 | Drew et al. |
| 4,506,943 | A | 3/1985 | Drogo |
| 4,515,427 | A | 5/1985 | Smit |
| 4,525,017 | A | 6/1985 | Schildkraut et al. |
| 4,531,790 | A | 7/1985 | Selvin |
| 4,531,805 | A | 7/1985 | Werth |
| 4,533,191 | A | 8/1985 | Blackwood |
| 4,540,231 | A | 9/1985 | Forney, Jr. |
| RE31,995 | E | 10/1985 | Ball |
| 4,545,633 | A | 10/1985 | McGeary |
| 4,545,637 | A | 10/1985 | Bosshard et al. |
| 4,553,877 | A | 11/1985 | Edvardsen |
| 4,575,274 | A | 3/1986 | Hayward |
| 4,580,862 | A | 4/1986 | Johnson |
| 4,580,865 | A | 4/1986 | Fryberger |
| 4,583,811 | A | 4/1986 | McMills |
| 4,585,289 | A | 4/1986 | Bocher |
| 4,588,246 | A | 5/1986 | Schildkraut et al. |
| 4,593,964 | A | 6/1986 | Forney, Jr. et al. |
| 4,596,434 | A | 6/1986 | Saba et al. |
| 4,596,435 | A | 6/1986 | Bickford |
| 4,597,621 | A | 7/1986 | Burns |
| 4,598,959 | A | 7/1986 | Selvin |
| 4,598,961 | A | 7/1986 | Cohen |
| 4,600,263 | A | 7/1986 | DeChamp et al. |
| 4,613,199 | A | 9/1986 | McGeary |
| 4,614,390 | A | 9/1986 | Baker |
| 4,616,900 | A | 10/1986 | Cairns |
| 4,623,205 | A | 11/1986 | Barron |
| 4,632,487 | A | 12/1986 | Wargula |
| 4,634,213 | A | 1/1987 | Larsson et al. |
| 4,640,572 | A | 2/1987 | Conlon |
| 4,645,281 | A | 2/1987 | Burger |
| 4,647,135 | A | 3/1987 | Reinhardt |
| 4,650,228 | A | 3/1987 | McMills et al. |
| 4,655,159 | A | 4/1987 | McMills |
| 4,655,534 | A | 4/1987 | Stursa |
| 4,660,921 | A | 4/1987 | Hauver |
| 4,666,190 | A | 5/1987 | Yamabe et al. |
| 4,666,231 | A | 5/1987 | Sheesley et al. |
| 4,668,043 | A | 5/1987 | Saba et al. |
| 4,670,574 | A | 6/1987 | Malcolm |
| 4,673,236 | A | 6/1987 | Musolff et al. |
| 4,674,809 | A | 6/1987 | Hollyday et al. |
| 4,674,818 | A | 6/1987 | McMills et al. |
| 4,676,577 | A | 6/1987 | Szegda |
| 4,682,832 | A | 7/1987 | Punako et al. |
| 4,684,201 | A | 8/1987 | Hutter |
| 4,688,876 | A | 8/1987 | Morelli |
| 4,688,878 | A | 8/1987 | Cohen et al. |
| 4,690,482 | A | 9/1987 | Chamberland et al. |
| 4,691,976 | A | 9/1987 | Cowen |
| 4,703,987 | A | 11/1987 | Gullusser et al. |
| 4,703,988 | A | 11/1987 | Raux et al. |
| 4,713,021 | A | 12/1987 | Kobler |
| 4,717,355 | A | 1/1988 | Mattis |
| 4,720,155 | A | 1/1988 | Schildkraut et al. |
| 4,728,301 | A | 3/1988 | Hemmer et al. |
| 4,734,050 | A | 3/1988 | Negre et al. |
| 4,734,666 | A | 3/1988 | Ohya et al. |
| 4,737,123 | A | 4/1988 | Paler et al. |
| 4,738,009 | A | 4/1988 | Down et al. |
| 4,738,628 | A | 4/1988 | Rees |
| 4,739,009 | A | 4/1988 | Down et al. |
| 4,739,126 | A | 4/1988 | Gutter et al. |
| 4,746,305 | A | 5/1988 | Nomura |
| 4,747,656 | A | 5/1988 | Miyahara et al. |
| 4,747,786 | A | 5/1988 | Hayashi et al. |
| 4,749,821 | A | 6/1988 | Linton et al. |
| 4,755,152 | A | 7/1988 | Elliot et al. |
| 4,757,297 | A | 7/1988 | Frawley |
| 4,759,729 | A | 7/1988 | Kemppainen et al. |
| 4,761,146 | A | 8/1988 | Sohoel |
| 4,772,222 | A | 9/1988 | Laudig et al. |
| 4,789,355 | A | 12/1988 | Lee |
| 4,789,759 | A | 12/1988 | Jones |
| 4,795,360 | A | 1/1989 | Newman et al. |
| 4,797,120 | A | 1/1989 | Ulery |
| 4,806,116 | A | 2/1989 | Ackerman |

(56) References Cited

U.S. PATENT DOCUMENTS 4,807,891 A 2/1989 Neher
4,808,128 A 2/1989 Werth
4,810,017 A 3/1989 Knak et al.
4,813,886 A 3/1989 Roos et al.
4,820,185 A 4/1989 Moulin
4,834,675 A 5/1989 Samchisen
4,834,676 A 5/1989 Tackett
4,835,342 A 5/1989 Guginsky
4,836,580 A 6/1989 Farrell
4,836,801 A 6/1989 Ramirez
4,838,813 A 6/1989 Pauza et al.
4,846,731 A 7/1989 Alwine
4,854,893 A 8/1989 Morris
4,857,014 A 8/1989 Alf et al.
4,867,489 A 9/1989 Patel
4,867,706 A 9/1989 Tang
4,869,679 A 9/1989 Szegda
4,874,331 A 10/1989 Iverson
4,881,912 A 11/1989 Thommen et al.
4,892,275 A 1/1990 Szegda
4,902,246 A 2/1990 Samchisen
4,906,207 A 3/1990 Banning et al.
4,915,651 A 4/1990 Bout
4,921,447 A 5/1990 Capp et al.
4,923,412 A 5/1990 Morris
4,925,403 A 5/1990 Zorzy
4,927,385 A 5/1990 Cheng
4,929,188 A 5/1990 Lionetto et al.
4,934,960 A 6/1990 Capp et al.
4,938,718 A 7/1990 Guendel
4,941,846 A 7/1990 Guimond et al.
4,952,174 A 8/1990 Sucht et al.
4,957,456 A 9/1990 Olson et al.
4,963,105 A 10/1990 Lewis et al.
4,964,805 A 10/1990 Gabany
4,964,812 A 10/1990 Siemon et al.
4,973,265 A 11/1990 Heeren
4,976,632 A 12/1990 Riches
4,979,911 A 12/1990 Spencer
4,990,104 A 2/1991 Schieferly
4,990,105 A 2/1991 Karlovich
4,990,106 A 2/1991 Szegda
4,992,061 A 2/1991 Brush, Jr. et al.
5,002,503 A 3/1991 Campbell et al.
5,007,861 A 4/1991 Stirling
5,011,422 A 4/1991 Yeh
5,011,432 A 4/1991 Sucht et al.
5,018,822 A 5/1991 Freismuth et al.
5,021,010 A 6/1991 Wright
5,024,606 A 6/1991 Ming-Hwa
5,030,126 A 7/1991 Hanlon
5,037,328 A 8/1991 Karlovich
5,046,964 A 9/1991 Welsh et al.
5,052,947 A 10/1991 Brodie et al.
5,055,060 A 10/1991 Down et al.
5,059,139 A 10/1991 Spinner
5,059,747 A 10/1991 Bawa et al.
5,062,804 A 11/1991 Jamet et al.
5,066,248 A 11/1991 Gaver, Jr. et al.
5,067,912 A 11/1991 Bickford et al.
5,073,129 A 12/1991 Szegda
5,074,809 A 12/1991 Rousseau et al.
5,080,600 A 1/1992 Baker et al.
5,083,943 A 1/1992 Tarrant
5,088,937 A 2/1992 Gabany
5,120,260 A 6/1992 Jackson
5,127,853 A 7/1992 McMills et al.
5,131,862 A 7/1992 Gershfeld
5,137,470 A 8/1992 Doles
5,137,471 A 8/1992 Verespej et al.
5,139,440 A 8/1992 Volk et al.
5,141,448 A 8/1992 Mattingly et al.
5,141,451 A 8/1992 Down
5,149,274 A 9/1992 Gallusser et al.
5,150,924 A 9/1992 Yokomatsu et al.
5,154,636 A 10/1992 Vaccaro et al.
5,161,993 A 11/1992 Leibfried, Jr.
5,166,477 A 11/1992 Perin, Jr. et al.
5,167,545 A 12/1992 O'Brien et al.
5,169,323 A 12/1992 Kawai et al.
5,176,530 A 1/1993 Reylek
5,176,533 A 1/1993 Sakurai et al.
5,181,161 A 1/1993 Hirose et al.
5,183,417 A 2/1993 Bools
5,186,501 A 2/1993 Mano
5,186,655 A 2/1993 Glenday et al.
5,195,904 A 3/1993 Cyvoct
5,195,905 A 3/1993 Pesci
5,195,906 A 3/1993 Szegda
5,205,547 A 4/1993 Mattingly
5,205,761 A 4/1993 Nilsson
D335,487 S 5/1993 Volk et al.
5,207,602 A 5/1993 McMills et al.
5,215,477 A 6/1993 Weber et al.
5,217,391 A 6/1993 Fisher, Jr.
5,217,392 A 6/1993 Hosler, Sr.
5,217,393 A 6/1993 Del Negro et al.
5,221,216 A 6/1993 Gabany et al.
5,227,587 A 7/1993 Paterek
5,247,424 A 9/1993 Harris et al.
5,263,880 A * 11/1993 Schwarz ..... H01R 13/405 174/538
5,269,701 A 12/1993 Leibfried, Jr.
5,281,762 A 1/1994 Long et al.
5,283,853 A 2/1994 Szegda
5,284,449 A 2/1994 Vaccaro
5,294,864 A 3/1994 Do
5,295,864 A 3/1994 Birch et al.
5,316,348 A 5/1994 Franklin
5,316,494 A 5/1994 Flanagan et al.
5,318,459 A 6/1994 Shields
5,321,205 A 6/1994 Bawa et al.
5,334,032 A 8/1994 Myers et al.
5,334,051 A 8/1994 Devine et al.
5,338,225 A 8/1994 Jacobsen et al.
5,342,218 A 8/1994 McMills et al.
5,352,134 A 10/1994 Jacobsen et al.
5,354,217 A 10/1994 Gabel et al.
5,362,250 A 11/1994 McMills et al.
5,362,251 A 11/1994 Bielak
5,366,260 A 11/1994 Wartluft
5,371,819 A 12/1994 Szegda
5,371,821 A 12/1994 Szegda
5,371,827 A 12/1994 Szegda
5,380,211 A 1/1995 Kawagauchi et al.
5,389,005 A 2/1995 Kodama
5,393,244 A 2/1995 Szegda
5,397,252 A 3/1995 Wang
5,413,504 A 5/1995 Kloecker et al.
5,431,583 A 7/1995 Szegda
5,435,745 A 7/1995 Booth
5,435,751 A 7/1995 Papenheim et al.
5,435,760 A 7/1995 Miklos
5,439,386 A 8/1995 Ellis et al.
5,444,810 A 8/1995 Szegda
5,455,548 A 10/1995 Grandchamp et al.
5,456,611 A 10/1995 Henry et al.
5,456,614 A 10/1995 Szegda
5,466,173 A 11/1995 Down
5,470,257 A 11/1995 Szegda
5,474,478 A 12/1995 Ballog
5,475,921 A 12/1995 Johnston
5,488,268 A 1/1996 Bauer et al.
5,490,033 A 2/1996 Cronin
5,490,801 A 2/1996 Fisher, Jr. et al.
5,494,454 A 2/1996 Johnsen
5,499,934 A 3/1996 Jacobsen et al.
5,501,616 A 3/1996 Holliday
5,511,305 A 4/1996 Garner
5,516,303 A 5/1996 Yohn et al.
5,525,076 A 6/1996 Down
5,542,861 A 8/1996 Anhalt et al.
5,548,088 A 8/1996 Gray et al.
5,550,521 A 8/1996 Bernaud et al.

(56) References Cited

U.S. PATENT DOCUMENTS 5,564,938 A 10/1996 Shenkal et al.
5,571,028 A 11/1996 Szegda
5,586,910 A 12/1996 Del Negro et al.
5,595,499 A 1/1997 Zander et al.
5,598,132 A 1/1997 Stabile
5,607,320 A 3/1997 Wright
5,607,325 A 3/1997 Toma
5,609,501 A 3/1997 McMills et al.
5,620,339 A 4/1997 Gray et al.
5,632,637 A 5/1997 Diener
5,632,651 A 5/1997 Szegda
5,644,104 A 7/1997 Porter et al.
5,649,723 A 7/1997 Larsson
5,651,698 A 7/1997 Locati et al.
5,651,699 A 7/1997 Holliday
5,653,605 A 8/1997 Woehl et al.
5,667,405 A 9/1997 Holliday
5,681,172 A 10/1997 Moldenhauer
5,683,263 A 11/1997 Hsu
5,702,263 A 12/1997 Baumann et al.
5,722,856 A 3/1998 Fuchs et al.
5,735,704 A 4/1998 Anthony
5,743,131 A 4/1998 Holliday et al.
5,746,617 A 5/1998 Porter, Jr. et al.
5,746,619 A 5/1998 Harting et al.
5,759,618 A 6/1998 Taylor
5,769,652 A 6/1998 Wider
5,769,662 A 6/1998 Stabile et al.
5,774,344 A 6/1998 Casebolt
5,775,927 A 7/1998 Wider
5,788,289 A 8/1998 Cronley
5,791,698 A 8/1998 Wartluft et al.
5,797,633 A 8/1998 Katzer et al.
5,817,978 A 10/1998 Hermant et al.
5,863,220 A 1/1999 Holliday
5,874,603 A 2/1999 Arkles
5,877,452 A 3/1999 McConnell
5,879,191 A 3/1999 Burris
5,882,226 A 3/1999 Bell et al.
5,890,924 A 4/1999 Endo
5,897,795 A 4/1999 Lu et al.
5,906,511 A 5/1999 Bozzer et al.
5,917,153 A 6/1999 Geroldinger
5,921,793 A 7/1999 Phillips
5,938,465 A 8/1999 Fox, Sr.
5,944,548 A 8/1999 Saito
5,951,327 A 9/1999 Marik
5,954,708 A 9/1999 Lopez et al.
5,957,716 A 9/1999 Buckley et al.
5,967,852 A 10/1999 Follingstad et al.
5,975,479 A 11/1999 Suter
5,975,591 A 11/1999 Guest
5,975,949 A 11/1999 Holliday et al.
5,975,951 A 11/1999 Burris et al.
5,977,841 A 11/1999 Lee et al.
5,997,350 A 12/1999 Burris et al.
6,010,349 A 1/2000 Porter, Jr.
6,019,635 A 2/2000 Nelson
6,022,237 A 2/2000 Esh
6,032,358 A 3/2000 Wild
6,036,540 A 3/2000 Beloritsky
6,042,422 A 3/2000 Youtsey
6,042,429 A * 3/2000 Bianca ..... H01R 13/41 439/733.1
6,048,229 A 4/2000 Lazaro, Jr.
6,053,743 A 4/2000 Mitchell et al.
6,053,769 A 4/2000 Kubota et al.
6,053,777 A 4/2000 Boyle
6,062,607 A 5/2000 Bartholomew
6,080,015 A 6/2000 Andreescu
6,083,030 A 7/2000 Wright
6,083,053 A 7/2000 Anderson, Jr. et al.
6,089,903 A 7/2000 Stafford Gray et al.
6,089,912 A 7/2000 Tallis et al.
6,089,913 A 7/2000 Holliday
6,093,043 A 7/2000 Gray et al.
6,095,828 A 8/2000 Burland
6,095,841 A 8/2000 Felps
6,123,550 A 9/2000 Burkert et al.
6,123,567 A 9/2000 McCarthy
6,126,487 A 10/2000 Rosenberger et al.
6,132,234 A 10/2000 Waidner et al.
6,142,812 A 11/2000 Hwang
6,146,197 A 11/2000 Holliday et al.
6,152,752 A 11/2000 Fukuda
6,152,753 A 11/2000 Johnson et al.
6,153,830 A 11/2000 Montena
6,162,995 A 12/2000 Bachle et al.
6,164,977 A 12/2000 Lester
6,174,206 B1 1/2001 Yentile et al.
6,183,298 B1 2/2001 Henningsen
6,199,913 B1 3/2001 Wang
6,199,920 B1 3/2001 Neustadtl
6,210,216 B1 4/2001 Tso-Chin et al.
6,210,219 B1 4/2001 Zhu et al.
6,210,222 B1 4/2001 Langham et al.
6,217,383 B1 4/2001 Holland et al.
6,238,240 B1 5/2001 Yu
6,239,359 B1 5/2001 Lilienthal, II et al.
6,241,553 B1 6/2001 Hsia
6,250,942 B1 6/2001 Lemke et al.
6,250,974 B1 6/2001 Kerek
6,257,923 B1 7/2001 Stone et al.
6,261,126 B1 7/2001 Stirling
6,267,612 B1 7/2001 Arcykiewicz et al.
6,271,464 B1 8/2001 Cunningham
6,331,123 B1 12/2001 Rodrigues
6,332,815 B1 12/2001 Bruce
6,352,448 B1 3/2002 Holliday et al.
6,358,077 B1 3/2002 Young
6,361,348 B1 3/2002 Hall et al.
6,361,364 B1 3/2002 Holland et al.
6,375,509 B2 4/2002 Mountford
6,379,183 B1 4/2002 Ayres et al.
6,394,840 B1 5/2002 Gassauer et al.
6,396,367 B1 5/2002 Rosenberger
D458,904 S 6/2002 Montena
6,398,571 B1 6/2002 Nishide et al.
6,406,330 B2 6/2002 Bruce
6,409,534 B1 6/2002 Weisz-Margulescu
D460,739 S 7/2002 Fox
D460,740 S 7/2002 Montena
D460,946 S 7/2002 Montena
D460,947 S 7/2002 Montena
D460,948 S 7/2002 Montena
6,422,884 B1 7/2002 Babasick et al.
6,422,900 B1 7/2002 Hogan
6,425,782 B1 7/2002 Holland
D461,166 S 8/2002 Montena
D461,167 S 8/2002 Montena
D461,778 S 8/2002 Fox
D462,058 S 8/2002 Montena
D462,060 S 8/2002 Fox
6,439,899 B1 8/2002 Muzslay et al.
D462,327 S 9/2002 Montena
6,443,763 B1 9/2002 Richet
6,450,829 B1 9/2002 Weisz-Margulescu
6,454,463 B1 9/2002 Halbach
6,464,526 B1 10/2002 Seufert et al.
6,464,527 B2 10/2002 Volpe et al.
6,467,816 B1 10/2002 Huang
6,468,100 B1 10/2002 Meyer et al.
6,491,546 B1 12/2002 Perry
D468,696 S 1/2003 Montena
6,506,083 B1 1/2003 Bickford et al.
6,510,610 B2 1/2003 Losinger
6,520,800 B1 2/2003 Michelbach et al.
6,530,807 B2 3/2003 Rodrigues et al.
6,540,531 B2 4/2003 Syed et al.
6,558,194 B2 5/2003 Montena
6,572,419 B2 6/2003 Feye-Homann
6,576,833 B2 6/2003 Covaro et al.
6,619,876 B2 9/2003 Vaitkus et al.

(56) References Cited

U.S. PATENT DOCUMENTS 6,632,104 B2 * 10/2003 Quadir ..... H01B 17/306 439/587
6,634,906 B1 10/2003 Yeh
6,637,101 B2 10/2003 Hathaway et al.
6,645,011 B2 11/2003 Schneider et al.
6,663,397 B1 12/2003 Lin et al.
6,676,446 B2 1/2004 Montena
6,683,253 B1 1/2004 Lee
6,683,773 B2 1/2004 Montena
6,692,285 B2 2/2004 Islam
6,692,286 B1 2/2004 De Cet
6,695,636 B2 2/2004 Hall et al.
6,705,875 B2 3/2004 Berghorn et al.
6,705,884 B1 3/2004 McCarthy
6,709,280 B1 3/2004 Gretz
6,709,289 B2 3/2004 Huber et al.
6,712,631 B1 3/2004 Youtsey
6,716,041 B2 4/2004 Ferderer et al.
6,716,062 B1 4/2004 Palinkas et al.
6,733,336 B1 5/2004 Montena et al.
6,733,337 B2 5/2004 Kodaira
6,743,040 B1 6/2004 Nakamura
6,749,454 B2 6/2004 Schmidt et al.
6,751,081 B1 6/2004 Kooiman
6,752,633 B2 6/2004 Aizawa et al.
6,761,571 B2 7/2004 Hida
6,767,248 B1 7/2004 Hung
6,769,926 B1 8/2004 Montena
6,780,029 B1 8/2004 Gretz
6,780,042 B1 8/2004 Badescu et al.
6,780,052 B2 8/2004 Montena et al.
6,780,068 B2 8/2004 Bartholoma et al.
6,783,394 B1 8/2004 Holliday
6,786,767 B1 9/2004 Fuks et al.
6,790,081 B2 9/2004 Burris et al.
6,793,528 B2 9/2004 Lin et al.
6,796,847 B2 9/2004 AbuGhazaleh
6,802,738 B1 10/2004 Henningsen
6,805,583 B2 10/2004 Holliday et al.
6,805,584 B1 10/2004 Chen
6,808,415 B1 10/2004 Montena
6,817,272 B2 11/2004 Holland
6,817,896 B2 11/2004 Derenthal
6,817,897 B2 11/2004 Chee
6,827,608 B2 12/2004 Hall et al.
6,830,479 B2 12/2004 Holliday
6,848,115 B2 1/2005 Sugiura et al.
6,848,939 B2 2/2005 Stirling
6,848,940 B2 2/2005 Montena
6,848,941 B2 2/2005 Wlos et al.
6,884,113 B1 4/2005 Montena
6,884,115 B2 4/2005 Malloy
6,887,102 B1 5/2005 Burris et al.
6,916,200 B2 7/2005 Burris et al.
6,929,265 B2 8/2005 Holland et al.
6,929,508 B1 8/2005 Holland
6,935,866 B2 8/2005 Kerekes et al.
6,939,169 B2 9/2005 Islam et al.
6,942,516 B2 9/2005 Shimoyama et al.
6,942,520 B2 9/2005 Barlian et al.
6,944,005 B2 * 9/2005 Kooiman ..... H01P 1/266 361/111
6,945,805 B1 9/2005 Bollinger
6,948,976 B2 9/2005 Goodwin et al.
6,953,371 B2 10/2005 Baker et al.
6,955,563 B1 10/2005 Croan
D511,497 S 11/2005 Murphy et al.
D512,024 S 11/2005 Murphy et al.
D512,689 S 12/2005 Murphy et al.
6,971,912 B2 12/2005 Montena et al.
6,979,234 B2 * 12/2005 Bleicher ..... H01R 12/585 439/733.1
7,008,263 B2 3/2006 Holland
7,018,216 B1 3/2006 Clark et al.
7,018,235 B1 3/2006 Burris et al.
7,029,326 B2 4/2006 Montena
D521,454 S 5/2006 Murphy et al.
7,063,565 B2 6/2006 Ward
7,070,447 B1 7/2006 Montena
7,077,697 B2 7/2006 Kooiman
7,077,699 B2 7/2006 Islam et al.
7,086,897 B2 8/2006 Montena
7,090,525 B1 8/2006 Morana
7,094,114 B2 8/2006 Kurimoto
7,097,499 B1 8/2006 Purdy
7,102,866 B2 9/2006 Bo
7,102,868 B2 9/2006 Montena
7,108,547 B2 9/2006 Kisling et al.
7,108,548 B2 9/2006 Burris et al.
7,112,078 B2 9/2006 Czikora
7,112,093 B1 9/2006 Holland
7,114,990 B2 10/2006 Bence et al.
7,118,285 B2 10/2006 Fenwick et al.
7,118,382 B2 10/2006 Kerekes et al.
7,118,416 B2 10/2006 Montena et al.
7,125,283 B1 10/2006 Lin
7,128,603 B2 10/2006 Burris et al.
7,128,604 B2 10/2006 Hall
7,131,867 B1 11/2006 Foster et al.
7,131,868 B2 11/2006 Montena
7,140,645 B2 11/2006 Cronley
7,144,271 B1 12/2006 Burris et al.
7,144,272 B1 12/2006 Burris et al.
7,147,509 B1 12/2006 Burris et al.
7,153,159 B2 12/2006 Burris et al.
7,156,696 B1 1/2007 Montena
7,161,785 B2 * 1/2007 Chawgo ..... H01T 4/08 361/119
7,165,974 B2 1/2007 Kooiman
7,173,121 B2 2/2007 Fang
7,179,121 B1 2/2007 Burris et al.
7,179,122 B2 2/2007 Holliday
7,182,639 B2 2/2007 Burris
7,183,639 B2 2/2007 Mihara et al.
7,189,097 B2 3/2007 Benham
7,189,114 B1 3/2007 Burris et al.
7,192,308 B2 3/2007 Rodrigues et al.
7,229,303 B2 6/2007 Vermoesen et al.
7,229,550 B2 6/2007 Montena
7,238,047 B2 7/2007 Saettele et al.
7,252,536 B2 8/2007 Lazaro, Jr. et al.
7,252,546 B1 8/2007 Holland
7,255,598 B2 8/2007 Montena et al.
7,261,594 B2 8/2007 Kodama et al.
7,264,502 B2 9/2007 Holland
7,278,882 B1 10/2007 Li
7,288,002 B2 10/2007 Rodrigues et al.
7,291,033 B2 11/2007 Hu
7,297,023 B2 11/2007 Chawgo
7,299,550 B2 11/2007 Montena
7,303,435 B2 12/2007 Burris et al.
7,311,555 B1 12/2007 Burris et al.
7,318,609 B2 1/2008 Naito et al.
7,322,846 B2 1/2008 Camelio
7,322,851 B2 1/2008 Brookmire
7,329,139 B2 2/2008 Benham
7,331,820 B2 2/2008 Burris et al.
7,335,058 B1 2/2008 Burris et al.
7,347,129 B1 3/2008 Youtsey
7,347,726 B2 3/2008 Wlos
7,347,727 B2 3/2008 Wlos et al.
7,347,729 B2 3/2008 Thomas et al.
7,351,088 B1 4/2008 Qu
7,357,641 B2 4/2008 Kerekes et al.
7,364,462 B2 4/2008 Holland
7,371,112 B2 5/2008 Burris et al.
7,371,113 B2 5/2008 Burris et al.
7,375,533 B2 5/2008 Gale
7,387,524 B2 6/2008 Cheng
7,393,245 B2 7/2008 Palinkas et al.
7,396,249 B2 7/2008 Kauffman
7,404,737 B1 7/2008 Youtsey
7,410,389 B2 8/2008 Holliday
7,416,415 B2 8/2008 Hart et al.

(56) References Cited

U.S. PATENT DOCUMENTS

| | | | |
|---|---|---|---|
| 7,438,327 | B2 | 10/2008 | Auray et al. |
| 7,452,239 | B2 | 11/2008 | Montena |
| 7,455,550 | B1 | 11/2008 | Sykes |
| 7,458,850 | B1 | 12/2008 | Burris et al. |
| 7,458,851 | B2 | 12/2008 | Montena |
| 7,462,068 | B2 | 12/2008 | Amidon |
| 7,467,980 | B2 | 12/2008 | Chiu |
| 7,476,127 | B1 | 1/2009 | Wei |
| 7,478,475 | B2 | 1/2009 | Hall |
| 7,479,033 | B1 | 1/2009 | Sykes et al. |
| 7,479,035 | B2 | 1/2009 | Bence et al. |
| 7,484,988 | B2 | 2/2009 | Ma et al. |
| 7,484,997 | B2 | 2/2009 | Hofling |
| 7,488,210 | B1 | 2/2009 | Burris et al. |
| 7,494,355 | B2 | 2/2009 | Hughes et al. |
| 7,497,729 | B1 | 3/2009 | Wei |
| 7,500,868 | B2 | 3/2009 | Holland et al. |
| 7,500,873 | B1 | 3/2009 | Hart |
| 7,507,116 | B2 | 3/2009 | Laerke et al. |
| 7,507,117 | B2 | 3/2009 | Amidon |
| 7,513,788 | B2 | 4/2009 | Camelio |
| 7,537,482 | B2 | 5/2009 | Burris et al. |
| 7,540,759 | B2 | 6/2009 | Liu et al. |
| 7,544,094 | B1 | 6/2009 | Paglia et al. |
| 7,563,133 | B2 | 7/2009 | Stein |
| 7,566,236 | B2 | 7/2009 | Malloy et al. |
| 7,568,945 | B2 | 8/2009 | Chee et al. |
| 7,578,693 | B2 | 8/2009 | Yoshida et al. |
| 7,588,454 | B2 | 9/2009 | Nakata et al. |
| 7,607,942 | B1 | 10/2009 | Van Swearingen |
| 7,625,227 | B1 | 12/2009 | Henderson et al. |
| 7,632,143 | B1 | 12/2009 | Islam |
| 7,635,283 | B1 | 12/2009 | Islam |
| 7,648,393 | B2 | 1/2010 | Burris et al. |
| 7,651,376 | B2 | 1/2010 | Schreier |
| 7,674,132 | B1 | 3/2010 | Chen |
| 7,682,177 | B2 | 3/2010 | Berthet |
| 7,682,188 | B1 | 3/2010 | Lu |
| 7,694,420 | B2 | 4/2010 | Ehret et al. |
| 7,714,229 | B2 | 5/2010 | Burris et al. |
| 7,726,996 | B2 | 6/2010 | Burris et al. |
| 7,727,011 | B2 | 6/2010 | Montena et al. |
| 7,749,021 | B2 | 7/2010 | Brodeur |
| 7,753,705 | B2 | 7/2010 | Montena |
| 7,753,710 | B2 | 7/2010 | George |
| 7,753,727 | B1 | 7/2010 | Islam et al. |
| 7,758,356 | B2 | 7/2010 | Burris et al. |
| 7,758,370 | B1 | 7/2010 | Flaherty |
| 7,794,275 | B2 | 9/2010 | Rodrigues |
| 7,806,714 | B2 | 10/2010 | Williams et al. |
| 7,806,725 | B1 | 10/2010 | Chen |
| 7,811,133 | B2 | 10/2010 | Gray |
| 7,814,654 | B2 | 10/2010 | Pichler |
| D626,920 | S | 11/2010 | Purdy et al. |
| 7,824,216 | B2 | 11/2010 | Purdy |
| 7,828,594 | B2 | 11/2010 | Burris et al. |
| 7,828,595 | B2 | 11/2010 | Mathews |
| 7,830,154 | B2 | 11/2010 | Gale |
| 7,833,053 | B2 | 11/2010 | Mathews |
| 7,845,976 | B2 | 12/2010 | Mathews |
| 7,845,978 | B1 | 12/2010 | Chen |
| 7,845,980 | B1 | 12/2010 | Amidon |
| 7,850,472 | B2 | 12/2010 | Friedrich et al. |
| 7,850,487 | B1 | 12/2010 | Wei |
| 7,857,661 | B1 | 12/2010 | Islam |
| 7,874,870 | B1 | 1/2011 | Chen |
| 7,887,354 | B2 | 2/2011 | Holliday |
| 7,892,004 | B2 | 2/2011 | Hertzler et al. |
| 7,892,005 | B2 | 2/2011 | Haube |
| 7,892,024 | B1 | 2/2011 | Chen |
| 7,914,326 | B2 | 3/2011 | Sutter |
| 7,918,687 | B2 | 4/2011 | Paynter et al. |
| 7,927,135 | B1 | 4/2011 | Wlos |
| 7,934,955 | B1 | 5/2011 | Hsia |
| 7,938,662 | B2 | 5/2011 | Burris et al. |
| 7,942,695 | B1 | 5/2011 | Lu |
| 7,950,958 | B2 | 5/2011 | Mathews |
| 7,950,961 | B2 | 5/2011 | Chabalowski et al. |
| 7,955,126 | B2 | 6/2011 | Bence et al. |
| 7,972,158 | B2 | 7/2011 | Wild et al. |
| 7,972,176 | B2 | 7/2011 | Burris et al. |
| 7,982,005 | B2 | 7/2011 | Ames et al. |
| 8,011,955 | B1 | 9/2011 | Lu |
| 8,025,518 | B2 | 9/2011 | Burris et al. |
| 8,029,315 | B2 | 10/2011 | Purdy et al. |
| 8,029,316 | B2 | 10/2011 | Snyder et al. |
| 8,037,599 | B2 | 10/2011 | Pichler |
| 8,047,872 | B2 | 11/2011 | Burris et al. |
| 8,062,044 | B2 | 11/2011 | Montena et al. |
| 8,062,063 | B2 | 11/2011 | Malloy et al. |
| 8,070,504 | B2 | 12/2011 | Amidon et al. |
| 8,075,337 | B2 | 12/2011 | Malloy et al. |
| 8,075,338 | B1 | 12/2011 | Montena |
| 8,079,860 | B1 | 12/2011 | Zraik |
| 8,087,954 | B2 | 1/2012 | Fuchs |
| 8,113,875 | B2 | 2/2012 | Malloy et al. |
| 8,113,879 | B1 | 2/2012 | Zraik |
| 8,157,587 | B2 | 4/2012 | Paynter et al. |
| 8,157,588 | B1 | 4/2012 | Rodrigues et al. |
| 8,167,635 | B1 | 5/2012 | Mathews |
| 8,167,636 | B1 | 5/2012 | Montena |
| 8,172,612 | B2 | 5/2012 | Bence et al. |
| 8,177,572 | B2 | 5/2012 | Feye-Hohmann |
| 8,192,237 | B2 | 6/2012 | Purdy et al. |
| 8,206,172 | B2 | 6/2012 | Katagiri et al. |
| D662,893 | S | 7/2012 | Haberek et al. |
| 8,231,412 | B2 | 7/2012 | Paglia et al. |
| 8,262,408 | B1 | 9/2012 | Kelly |
| 8,272,893 | B2 | 9/2012 | Burris et al. |
| 8,287,310 | B2 | 10/2012 | Burris et al. |
| 8,287,320 | B2 | 10/2012 | Purdy et al. |
| 8,313,345 | B2 | 11/2012 | Purdy |
| 8,313,353 | B2 | 11/2012 | Purdy et al. |
| 8,317,539 | B2 | 11/2012 | Stein |
| 8,319,136 | B2 | 11/2012 | Byron et al. |
| 8,323,053 | B2 | 12/2012 | Montena |
| 8,323,058 | B2 | 12/2012 | Flaherty et al. |
| 8,323,060 | B2 | 12/2012 | Purdy et al. |
| 8,337,229 | B2 | 12/2012 | Montena |
| 8,366,481 | B2 | 2/2013 | Ehret et al. |
| 8,366,482 | B2 | 2/2013 | Burris et al. |
| 8,376,769 | B2 | 2/2013 | Holland et al. |
| D678,844 | S | 3/2013 | Haberek |
| 8,398,421 | B2 | 3/2013 | Haberek et al. |
| 8,430,688 | B2 | 4/2013 | Montena et al. |
| 8,449,326 | B2 | 5/2013 | Holland et al. |
| 8,465,322 | B2 | 6/2013 | Purdy |
| 8,469,739 | B2 | 6/2013 | Rodrigues et al. |
| 8,469,740 | B2 | 6/2013 | Ehret et al. |
| D686,164 | S | 7/2013 | Haberek et al. |
| D686,576 | S | 7/2013 | Haberek et al. |
| 8,475,205 | B2 | 7/2013 | Ehret et al. |
| 8,480,430 | B2 | 7/2013 | Ehret et al. |
| 8,480,431 | B2 | 7/2013 | Ehret et al. |
| 8,485,845 | B2 | 7/2013 | Ehret et al. |
| 8,506,325 | B2 | 8/2013 | Malloy et al. |
| 8,517,763 | B2 | 8/2013 | Burris et al. |
| 8,517,764 | B2 | 8/2013 | Wei et al. |
| 8,529,279 | B2 | 9/2013 | Montena |
| 8,550,835 | B2 | 10/2013 | Montena |
| 8,568,163 | B2 | 10/2013 | Burris et al. |
| 8,568,165 | B2 | 10/2013 | Wei et al. |
| 8,591,244 | B2 | 11/2013 | Thomas et al. |
| 8,597,050 | B2 | 12/2013 | Flaherty et al. |
| 8,622,776 | B2 | 1/2014 | Morikawa |
| 8,636,529 | B2 | 1/2014 | Stein |
| 8,636,541 | B2 | 1/2014 | Chastain et al. |
| 8,647,136 | B2 | 2/2014 | Purdy et al. |
| 8,690,603 | B2 | 4/2014 | Bence et al. |
| 8,721,365 | B2 | 5/2014 | Holland |
| 8,727,800 | B2 | 5/2014 | Holland et al. |
| 8,758,050 | B2 | 6/2014 | Montena |
| 8,777,658 | B2 | 7/2014 | Holland et al. |
| 8,777,661 | B2 | 7/2014 | Holland et al. |

(56) References Cited

U.S. PATENT DOCUMENTS 8,858,251 B2 10/2014 Montena
8,888,526 B2 11/2014 Burris
8,920,192 B2 12/2014 Montena
9,017,101 B2 4/2015 Ehret et al.
9,048,599 B2 6/2015 Burris
9,153,911 B2 10/2015 Burris et al.
9,166,348 B2 10/2015 Burris et al.
9,172,154 B2 10/2015 Burris
9,172,157 B2 10/2015 Burris
2001/0034143 A1 10/2001 Annequin
2001/0046802 A1 11/2001 Perry et al.
2001/0051448 A1 12/2001 Gonzales
2002/0013088 A1 1/2002 Rodrigues et al.
2002/0019161 A1 2/2002 Finke et al.
2002/0038720 A1 4/2002 Kai et al.
2002/0064014 A1* 5/2002 Montena ..... H01T 4/08 361/117
2002/0146935 A1 10/2002 Wong
2003/0110977 A1 6/2003 Batlaw
2003/0119358 A1 6/2003 Henningsen
2003/0139081 A1 7/2003 Hall et al.
2003/0194890 A1 10/2003 Ferderer et al.
2003/0214370 A1 11/2003 Allison et al.
2003/0224657 A1 12/2003 Malloy
2004/0031144 A1 2/2004 Holland
2004/0077215 A1 4/2004 Palinkas et al.
2004/0102089 A1 5/2004 Chee
2004/0137778 A1 7/2004 Mattheeuws et al.
2004/0157499 A1 8/2004 Nania et al.
2004/0194585 A1 10/2004 Clark
2004/0209516 A1 10/2004 Burris et al.
2004/0219833 A1 11/2004 Burris et al.
2004/0229504 A1 11/2004 Liu
2005/0042919 A1 2/2005 Montena
2005/0079762 A1 4/2005 Hsia
2005/0159045 A1 7/2005 Huang
2005/0170692 A1 8/2005 Montena
2005/0181652 A1 8/2005 Montena et al.
2005/0181668 A1 8/2005 Montena et al.
2005/0208827 A1 9/2005 Burris et al.
2005/0233636 A1 10/2005 Rodrigues et al.
2006/0014425 A1 1/2006 Montena
2006/0099853 A1 5/2006 Sattele et al.
2006/0110977 A1 5/2006 Matthews
2006/0154519 A1 7/2006 Montena
2006/0166552 A1 7/2006 Bence et al.
2006/0178034 A1 8/2006 Shimirak
2006/0178046 A1 8/2006 Tusini
2006/0194465 A1 8/2006 Czikora
2006/0199040 A1 9/2006 Yamada
2006/0223355 A1 10/2006 Hirschmann
2006/0246774 A1 11/2006 Buck
2006/0258209 A1 11/2006 Hall
2006/0276079 A1 12/2006 Chen
2007/0004276 A1 1/2007 Stein
2007/0026734 A1 2/2007 Bence et al.
2007/0049113 A1 3/2007 Rodrigues et al.
2007/0054535 A1 3/2007 Hall et al.
2007/0059968 A1 3/2007 Ohtaka et al.
2007/0082533 A1 4/2007 Currier et al.
2007/0087613 A1 4/2007 Schumacher et al.
2007/0123101 A1 5/2007 Palinkas
2007/0155232 A1 7/2007 Burris et al.
2007/0173100 A1 7/2007 Benham
2007/0175027 A1 8/2007 Khemakhem et al.
2007/0232117 A1 10/2007 Singer
2007/0243759 A1 10/2007 Rodrigues et al.
2007/0243762 A1 10/2007 Burke et al.
2007/0287328 A1 12/2007 Hart et al.
2008/0032556 A1 2/2008 Schreier
2008/0102696 A1 5/2008 Montena
2008/0171466 A1 7/2008 Buck et al.
2008/0200066 A1 8/2008 Hofling
2008/0200068 A1 8/2008 Aguirre
2008/0214040 A1 9/2008 Holterhoff et al.
2008/0289470 A1 11/2008 Aston
2008/0310026 A1 12/2008 Nakayama
2009/0029590 A1 1/2009 Sykes et al.
2009/0098770 A1 4/2009 Bence et al.
2009/0104801 A1 4/2009 Silva
2009/0163075 A1 6/2009 Blew et al.
2009/0186505 A1 7/2009 Mathews
2009/0264003 A1 10/2009 Hertzler et al.
2009/0305560 A1 12/2009 Chen
2010/0007441 A1 1/2010 Yagisawa et al.
2010/0022125 A1 1/2010 Burris et al.
2010/0028563 A1 2/2010 Ota
2010/0055978 A1 3/2010 Montena
2010/0080563 A1 4/2010 DiFonzo et al.
2010/0081321 A1 4/2010 Malloy et al.
2010/0081322 A1 4/2010 Malloy et al.
2010/0087071 A1 4/2010 DiFonzo et al.
2010/0105246 A1 4/2010 Burris et al.
2010/0124839 A1 5/2010 Montena
2010/0130060 A1 5/2010 Islam
2010/0178799 A1 7/2010 Lee
2010/0216339 A1 8/2010 Burris et al.
2010/0233901 A1 9/2010 Wild et al.
2010/0233902 A1 9/2010 Youtsey
2010/0233903 A1 9/2010 Islam
2010/0255719 A1 10/2010 Purdy
2010/0255721 A1 10/2010 Purdy et al.
2010/0279548 A1 11/2010 Montena et al.
2010/0297871 A1 11/2010 Haube
2010/0297875 A1 11/2010 Purdy et al.
2010/0304579 A1 12/2010 Kisling
2010/0323541 A1 12/2010 Amidon et al.
2011/0021072 A1 1/2011 Purdy
2011/0021075 A1 1/2011 Orner et al.
2011/0027039 A1 2/2011 Blair
2011/0039448 A1 2/2011 Stein
2011/0053413 A1 3/2011 Mathews
2011/0074388 A1 3/2011 Bowman
2011/0080158 A1 4/2011 Lawrence et al.
2011/0111623 A1 5/2011 Burris et al.
2011/0111626 A1 5/2011 Paglia et al.
2011/0117774 A1 5/2011 Malloy et al.
2011/0143567 A1 6/2011 Purdy et al.
2011/0151714 A1 6/2011 Flaherty et al.
2011/0230089 A1 9/2011 Amidon et al.
2011/0230091 A1 9/2011 Krenceski et al.
2011/0237123 A1 9/2011 Burris et al.
2011/0237124 A1 9/2011 Flaherty et al.
2011/0250789 A1 10/2011 Burris et al.
2011/0318958 A1 12/2011 Burris et al.
2012/0021642 A1 1/2012 Zraik
2012/0040537 A1 2/2012 Burris
2012/0045933 A1 2/2012 Youtsey
2012/0064768 A1 3/2012 Islam et al.
2012/0094530 A1 4/2012 Montena
2012/0100751 A1 4/2012 Montena
2012/0108098 A1 5/2012 Burris et al.
2012/0122329 A1 5/2012 Montena
2012/0129387 A1 5/2012 Holland et al.
2012/0171894 A1 7/2012 Malloy et al.
2012/0178289 A1 7/2012 Holliday
2012/0202378 A1 8/2012 Krenceski et al.
2012/0222302 A1 9/2012 Purdy et al.
2012/0225581 A1 9/2012 Amidon et al.
2012/0315788 A1 12/2012 Montena
2013/0065433 A1 3/2013 Burris
2013/0072057 A1 3/2013 Burris
2013/0178096 A1 7/2013 Matzen
2013/0273761 A1 10/2013 Ehret et al.
2014/0106612 A1 4/2014 Burris
2014/0106613 A1 4/2014 Burris
2014/0120766 A1 5/2014 Meister et al.
2014/0137393 A1 5/2014 Chastain et al.
2014/0148044 A1 5/2014 Balcer et al.
2014/0148051 A1 5/2014 Bence et al.
2014/0154907 A1 6/2014 Ehret et al.
2014/0298650 A1 10/2014 Chastain et al.
2014/0322968 A1 10/2014 Burris

(56) References Cited

U.S. PATENT DOCUMENTS

| | | | |
|---|---|---|---|
| 2014/0342605 | A1 | 11/2014 | Burris et al. |
| 2015/0118901 | A1 | 4/2015 | Burris |
| 2015/0295331 | A1 | 10/2015 | Burris |

FOREIGN PATENT DOCUMENTS

| | | |
|---|---|---|
| CN | 201149937 | 11/2008 |
| CN | 201178228 | 1/2009 |
| CN | 201904508 | 7/2011 |
| DE | 47931 | 10/1888 |
| DE | 102289 | 7/1897 |
| DE | 1117687 | 11/1961 |
| DE | 2261973 | 6/1974 |
| DE | 3117320 | 4/1982 |
| DE | 3211008 | 10/1983 |
| DE | 9001608.4 | 4/1990 |
| DE | 4439852 | 5/1996 |
| DE | 19749130 | 8/1999 |
| DE | 19957518 | 9/2001 |
| DE | 10346914 | 5/2004 |
| EP | 115179 | 8/1984 |
| EP | 116157 | 8/1984 |
| EP | 167738 | 1/1986 |
| EP | 72104 | 2/1986 |
| EP | 223464 | 5/1987 |
| EP | 265276 | 4/1988 |
| EP | 350835 | 1/1990 |
| EP | 428424 | 5/1991 |
| EP | 867978 | 9/1998 |
| EP | 1069654 | 9/1998 |
| EP | 1094565 | 4/2001 |
| EP | 1115179 | 7/2001 |
| EP | 1191268 | 3/2002 |
| EP | 1455420 | 9/2004 |
| EP | 1501159 | 1/2005 |
| EP | 1548898 | 6/2005 |
| EP | 1603200 | 12/2005 |
| EP | 1701410 | 9/2006 |
| EP | 2051340 | 4/2009 |
| FR | 2204331 | 5/1974 |
| FR | 2232846 | 1/1975 |
| FR | 2462798 | 2/1981 |
| FR | 2494508 | 5/1982 |
| GB | 589697 | 6/1947 |
| GB | 1087228 | 10/1967 |
| GB | 1270846 | 4/1972 |
| GB | 1332888 | 10/1973 |
| GB | 1401373 | 7/1975 |
| GB | 1421215 | 1/1976 |
| GB | 2019665 | 10/1979 |
| GB | 2079549 | 1/1982 |
| GB | 2252677 | 8/1992 |
| GB | 2264201 | 8/1993 |
| GB | 2331634 | 5/1999 |
| GB | 2448595 | 10/2008 |
| GB | 2450248 | 12/2008 |
| JP | 3280369 | 12/1991 |
| JP | 200215823 | 1/2002 |
| JP | 4129978 | 8/2008 |
| JP | 2009277571 | 11/2009 |
| JP | 4391268 | 12/2009 |
| JP | 4503793 | 7/2010 |
| KR | 100622526 | 9/2006 |
| TW | 427044 | 3/2001 |
| WO | 8700351 | 1/1987 |
| WO | 00/05785 | 2/2000 |
| WO | 0186756 | 11/2001 |
| WO | 02069457 | 9/2002 |
| WO | 2004013883 | 2/2004 |
| WO | 2004098795 | 11/2004 |
| WO | 2006081141 | 8/2006 |
| WO | 2007062845 | 6/2007 |
| WO | 2009066705 | 5/2009 |
| WO | 2010135181 | 11/2010 |
| WO | 2011057033 | 5/2011 |
| WO | 2012162431 | 5/2011 |
| WO | 2011128665 | 10/2011 |
| WO | 2011128666 | 10/2011 |
| WO | 2013126629 | 8/2013 |

OTHER PUBLICATIONS

Corning Gilbert 2004 OEM Coaxial Products Catalog, Quick Disconnects, 2 pages.

Digicon AVL Connector. ARRIS Group Inc. [online] 3 pages. Retrieved from the Internet: <URL: http://www.arrisi.com/special/digiconAVL.asp . . . .

US Office Action, U.S. Appl. No. 10/997,218; Jul. 31, 2006, pp. 1-10.

Society of Cable Telecommunications Engineers, Engineering Committee, Interface Practices Subcommittee; American National Standard; ANSI/SCTE Jan. 2006; Specification for "F" Port, Female, Outdoor. Published Jan. 2006. 9 pages.

The American Society of Mechanical Engineers; "Lock Washers (Inch Series), An American National Standard"; ASME 818.21.1-1999 (Revision of ASME B18.21.1-1994); Reaffirmed 2005. Published Feb. 11, 2000. 28 pages.

Notice of Allowance (Mail Date Mar. 20, 2012) for U.S. Appl. No. 13/117,843.

Search Report dated Jun. 6, 2014 pertaining to International application No. PCT/US2014/023374.

Search Report dated Apr. 9, 2014 pertaining to International application No. PCT/US2014/015934.

Society of Cable Telecommunications Engineers, Engineering Committee, Interface Practices Subcommittee; American National Standard; ANSI/SCTE Feb. 2006; "Specification for "F" Port, Female, Indoor". Published Feb. 2006. 9 pages.

PPC, "Next Generation Compression Connectors," pp. 1-6, Retrieved from http://www.tessco.com/yts/partnearnanufacturer list/vendors/ppc/pdf/ppcdigital spread.pdf.

Patent Cooperation Treaty, International Search Report for PCT/US2013/070497, Feb. 11, 2014, 3 pgs.

Patent Cooperation Treaty, International Search Report for PCT/US2013/064515, 10 pgs.

Patent Cooperation Treaty, International Search Report for PCT/US2013/064512, Jan. 21, 2014, 11 pgs.

Huber+Suhner AG, RF Connector Guide: Understanding connector technology, 2007, Retrieved from http://www.ie.itcr.ac.cr/marin/lic/e14515/HUBER+SUENER_RF_Connector_Guide.pdf.

Slade, Paul G,. Electrical Contacts: Principles and Applications, 1999, Retrieved from http://books.google.com/books (table of contents only).

U.S. Reexamination Control No. 95/002,400 filed Sep. 15, 2012, regarding U.S. Pat. No. 8,192,237 filed Feb. 23, 2011 (Purdy et al.).

U.S. Inter Partes Review Case No. 2013-00346 filed Jun. 10, 2013, regarding U.S. Pat. No. 8,287,320 filed Dec. 8, 2009, claims 1-8, 10-16, 18-31 (Purdy et al.).

U.S. Inter Partes Review Case No. 2013-00343 filed Jun. 10, 2013, regarding U.S. Pat. No. 8,313,353 filed Apr. 30, 2012, claims 1-6 (Purdy et al.).

U.S. Inter Partes Review Case No. 2013-00340 filed Jun. 10, 2013, regarding U.S. Pat. No. 8,323,060 filed Jun. 14, claims 1-9 (Purdy et al.).

U.S. Inter Partes Review Case No. 2013-00347 filed Jun. 10, 2013, regarding U.S. Pat. No. 8,287,320 filed Dec. 8, 2009, claims 9, 17, 32 (Purdy et al.).

U.S. Inter Partes Review Case No. 2013-00345 filed Jun. 10, 2013, regarding U.S. Pat. No. 8,313,353 filed Apr. 30, 2012, claims 7-27 (Purdy et al.).

U.S. Inter Partes Review Case No. 2013-00342 filed Jun. 10, 2013, regarding U.S. Pat. No. 8,323,060 filed Jun. 14, 2012, claims 10-25 (Purdy et al.).

U.S. Inter Partes Review Case No. 2014-00441 filed Feb. 18, 2014, regarding U.S. Pat. No. 8,562,366 filed Oct. 15, 2012, claims 31,37, 39, 41, 42, 55 56 (Purdy et al.).

(56) References Cited

OTHER PUBLICATIONS

U.S. Inter Partes Review Case No. 2014-00440 filed Feb. 18, 2014, regarding U.S. Pat. No. 8,597,041 filed Oct. 15, 2012, claims 1, 8, 9, 11, 18-26, 29 (Purdy et al.).
Office Action dated Jun. 12, 2014 pertaining to U.S. Appl. No. 13/795,737.
Office Action dated Aug. 25, 2014 pertaining to U.S. Appl. No. 13/605,481.
Election/Restrictions Requirement dated Jul. 31, 2014 pertaining to U.S. Appl. No. 13/652,969.
Office Action dated Aug. 29, 2014 pertaining to U.S. Appl. No. 13/827,522.
Election/Restrictions Requirement dated Jun. 20, 2014 pertaining to U.S. Appl. No. 13/795,780.
Office Action dated Sep. 19, 2014 pertaining to U.S. Appl. No. 13/795,780.
Office Action dated Oct. 6, 2014 pertaining to U.S. Appl. No. 13/732,679.
Corning Cabelcon waterproof CX3 7.0 QuickMount for RG6 cables; Cabelcon Connectors; www.cabelcom.dk; Mar. 15, 2012.
Maury Jr., M.; Microwave Coaxial Connector Technology: A Continuaing Evolution; Maury Microwave Corporation; Dec. 13, 2005; pp. 1-21; Maury Microwave Inc.
"Snap-On/Push-On" SMA Adapter; RF TEC Mfg., Inc.; Mar. 23, 2006; 2 pgs.
RG6 quick mount data sheet; Corning Cabelcon; 2010; 1 pg.; Corning Cabelcon ApS.
RG11 quick mount data sheet; Corning Cabelcon; 2013; 1 pg.; Corning Cabelcon ApS.
Gilbert Engineering Co., Inc.; OEM Coaxial Connectors catalog; Aug. 1993; p. 26.
UltraEase Compression Connectors; "F" Series 59 and 6 Connectors Product Information; May 2005; 4 pgs.
Pomona Electronics Full Line Catelog; vol. 50; 2003; pp. 1-100.
Office Action dated Dec. 31, 2014 pertaining to U.S. Appl. No. 13/605,498.
Office Action dated Dec. 16, 2014 pertaining to U.S. Appl. No. 13/653,095.
Office Action dated Dec. 19, 2014 pertaining to U.S. Appl. No. 13/652,969.
Office Action dated Dec. 29, 2014 pertaining to U.S. Appl. No. 13/833,793.
Notice of Allowance dated Feb. 2, 2015 pertaining to U.S. Appl. No. 13/795,737.
Office Action dated Feb. 25, 2015 pertaining to U.S. Appl. No. 13/605,481.
Office Action dated Feb. 18, 2015 pertaining to U.S. Appl. No. 13/827,522.
Office Action dated Mar. 19, 2015 pertaining to U.S. Appl. No. 13/795,780.
Patent Cooperation Treaty, International Search Report for PCT/US2014/037841, Mail Date Aug. 19, 2014, 3 pages.
Office Action dated Jun. 24, 2015 pertaining to U.S. Appl. No. 13/652,969.
Patent Cooperation Treaty, International Preliminary Report on Patentability for PCT/US2013/064512, mail date Apr. 30, 2015, 9 pages.
Patent Cooperation Treaty, International Preliminary Report on Patentability for PCT/US2013/064515, mail date Apr. 30, 2015, 8 pages.
Office Action dated Jun. 24, 2015 pertaining to U.S. Appl. No. 14/259,703.
Office Action dated Jul. 20, 2015 pertaining to U.S. Appl. No. 14/279,870.
Office Action dated Feb. 2, 2016 pertaining to U.S. Appl. No. 14/259,703.
Office Action dated Oct. 7, 2015 pertaining to U.S. Appl. No. 13/927,537.
Search Report dated Oct. 7, 2014 pertaining to International application No. PCT/US2014/043311.
Report on the Filing or Determination of an Action Regarding a Patent or Trademark regarding U.S. Pat. Nos. 8,313,353; 8,313,345; 8,323,060—Eastern District of Arkansas.
Report on the Filing or Determination of an Action Regarding a Patent or Trademark regarding U.S. Pat. Nos. 8,192,237; 8,287,320; 8,313,353; 8,323,060—Northern District of New York.
Report on the Filing or Determination of an Action Regarding a Patent or Trademark regarding U.S. Pat. No. 8,562,366—Northern District of New York.

* cited by examiner

SURGE PROTECTED COAXIAL TERMINATION

RELATED APPLICATIONS

This application claims the benefit of priority under 35 U.S.C. §119 of U.S. Provisional Application No. 62/118,684 filed on Feb. 20, 2015, the content of which is relied upon and incorporated herein by reference in its entirety.

BACKGROUND

Field

The present disclosure relates generally to coaxial terminations used to terminate ports that are adapted to receive coaxial cable connectors, and more particularly, to an improved coaxial termination that offers enhanced protection against repeated high-voltage surges.

Technical Background

RF coaxial cable systems are used in the cable television industry for distributing radio frequency signals to subscribers of cable television service, and more recently, voice and data telecommunications services. The coaxial cables used to route such signals include a center conductor for transmitting a radio frequency signal, and a surrounding, grounded outer conductive braid or sheath. Typically, the coaxial cable includes a dielectric material surrounding the center conductor and spacing it from the grounded outer sheath. The diameter of the center conductor, and the diameter of the outer conductor, and type of dielectric are selected to produce a characteristic impedance, such as 75 ohms, in the coaxial line. This same coaxial cable is sometimes used to provide AC power (typically 60-90 Vrms) to the equipment boxes that require external power to function.

Within such coaxial cable systems, such coaxial lines are typically coupled at their ends to equipment boxes, such as signal splitters, amplifiers, etc. These equipment boxes often have several internally-threaded coaxial ports adapted to receive end connectors of coaxial cables. If one or more of such coaxial ports is to be left "open", i.e., a coaxial cable is not going to be secured to such port, then it is necessary to "terminate" such port with a coaxial termination that matches the characteristic impedance of the coaxial line (e.g., a 75 ohm termination). If such a coaxial termination is omitted, then undesired reflected signals interfere with the proper transmission of the desired radio frequency signal.

When deployed in the field, as in cable TV systems, for example, these known coaxial termination devices can be subjected to power surges caused by lightning strikes and other events. These power surges can damage or destroy the resistive and/or capacitive elements in such a termination, rendering it non-functional.

An older specified surge test, ANSI C62.41 Category B3, specified that a 6,000 Volt open circuit/3,000 Amp short circuit surge pulse be injected into the coaxial termination device. At least some of the known coaxial termination devices have difficulty complying with such surge test. Indeed, efforts to make the resistive and capacitive components larger, in order to withstand such power surges, can have the negative impacts of increased costs and/or creating a larger impedance mismatch, and hence, causing poorer levels of RF Return Loss performance. One approach to designing a termination that can withstand the previously mentioned 6,000 Volt surges would be to use a 6,000 Volt capacitor and a high power resistor. Unfortunately, such components are relatively expensive and have a much larger physical size, which tends to increase the size and cost of the housing necessary to contain such components, thereby resulting in a much bulkier and more costly design. In more recent times, a newer surge test (ANSI/SCTE 81 2012) has been introduced by the industry requiring a different test profile as summarized in table 1 below. Older designs such as that related in U.S. Pat. No. 6,751,081 (Kooiman) exhibit severe Return Loss degradation after subjection to this newer surge test profile.

SUMMARY

Briefly described, and in accordance with various embodiments provided, the present disclosure relates to a surge-protected coaxial termination that includes a metallic outer body having a central bore extending therethrough, a center conductor extending into the central bore of the metallic outer body, and a spark gap created within such coaxial termination for allowing a high-voltage power surge to discharge across the spark gap without damaging other components (e.g., resistive and/or capacitive components) that might also be included in such coaxial termination.

In one embodiment, a surge-protected coaxial termination is provided. The surge-protected coaxial termination includes a metallic outer body having a central bore extending therethrough along a longitudinal axis between first and second ends of the metallic outer body. The central bore is bounded by an inner wall having an inwardly-directed radial step portion extending into the central bore. The inner wall and radial stem together define: a first portion of the central bore disposed on a first side of the radial step, a second orifice portion of the central bore disposed generally at the radial step, and a third portion of the central bore disposed on a second opposing side of the radial step. A center conductor extends into the central bore of the metallic outer body and into each of the first, second and third portions of the central bore. The center conductor further includes a first cylindrical portion disposed at least partially within the first portion of the central bore, a second central portion disposed at least partially within the second orifice portion of the central bore in close proximity to the radial step of the body to form a spark gap therebetween, and a third cylindrical portion disposed at least partially within the third portion of the central bore. The third rearward cylindrical portion of the center conductor is at least partially surrounded by an insulator layer. Air is disposed within at least a portion of the spark gap formed between the radial step of the body and the second central portion of the center conductor.

In another embodiment, a surge-protected coaxial termination is provided. The surge-protected coaxial termination includes a metallic outer body having a central bore extending therethrough along a longitudinal axis between first and second ends of the metallic outer body. The central bore is bounded by an inner wall having an inwardly-directed radial step portion extending into the central bore. The inner wall and the radial step define a first portion of the central bore disposed on a first side of the radial step, and a second orifice portion of the central bore disposed generally at the radial step. A center conductor extends into the central bore of the metallic outer body and into each of the first and second portions of the central bore. The center conductor includes a first cylindrical portion disposed at least partially within the first portion of the central bore, and a second enlarged central portion disposed at least partially within the second orifice portion of the central bore in close proximity to the radial step of the body to form a spark gap therebetween. The second enlarged central portion of the center conductor having an axial length and a diameter. A ratio of the axial length to the diameter of the second enlarged central portion, in some embodiments, is in a range from approximately 0.3 to 1 to approximately 1.3 to 1. Air is disposed within at least a portion of the spark gap formed between the radial step of the body and the enlarged central portion of the center conductor.

Additional features and advantages will be set forth in the detailed description which follows, and in part will be readily apparent to those skilled in the art from that description or recognized by practicing the embodiments as described herein, including the detailed description which follows, the claims, as well as the appended drawings.

It is to be understood that both the foregoing general description and the following detailed description are merely exemplary, and are intended to provide an overview or framework to understanding the nature and character of the claims. The accompanying drawings are included to provide a further understanding, and are incorporated in and constitute a part of this specification. The drawings illustrate embodiments, and together with the description serve to explain principles and operation of the various embodiments.

DETAILED DESCRIPTION

Embodiments of the present disclosure are directed to a surge-protected coaxial termination that includes a metallic outer body having a central bore extending therethrough, a center conductor extending into the central bore of the metallic outer body, and a spark gap created within such coaxial termination for allowing a high-voltage power surge to discharge across the spark gap without damaging other components (e.g., resistive and/or capacitive components) that might also be included in such coaxial termination.

Figure 1:
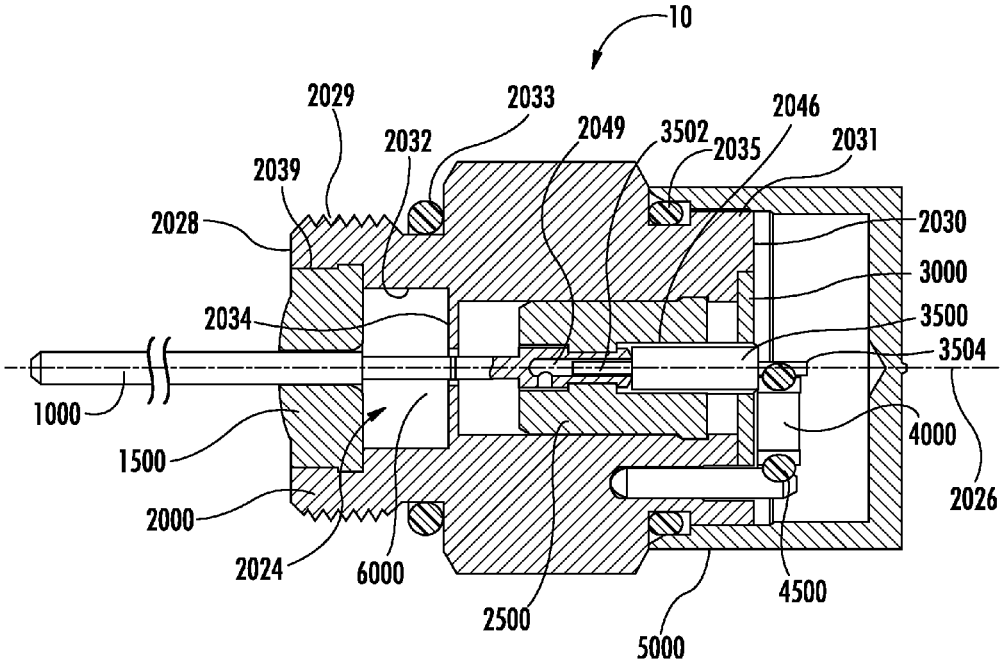
FIG. 1 PRIOR ART
FIG. 1 schematically depicts a cross-sectional view of an example surge protected coaxial termination.

Referring now to FIG. 1, a cross-sectional view of a typical surge protected coaxial termination 10 is shown. The surge protected coaxial termination 10 includes a metallic outer body 2000. The body 2000, for example, may incorporate a hex-shaped outer profile for receiving jaws of a wrench when the surge protected coaxial terminations 10 is tightened onto a coaxial port of a transmission line equipment box. The metallic outer body 2000 includes a central bore 2024, or central passage, extending therethrough along a longitudinal axis 2026 between a first end 2028 and a second end 2030 of the metallic outer body 2000. The central bore 2024 is defined by an inner wall 2032. As shown in FIG. 1, an inwardly-directed radial step 2034 extends from the inner wall 2032 toward the central axis 2026. The step 2034 is relatively short in the sense that its length along the central axis 2026 is very short in comparison with the axial length of the remaining portion of the inner wall 2032. Likewise, the inner diameter of the inner wall 2032 within the step portion 2034 is significantly smaller than the inner diameter of the remaining portion of the inner wall 2032.

As shown in FIG. 1, the first end 2028 of the outer body includes external mounting threads 2029 that may be used to secure the surge protected coaxial termination 10 to an unterminated coaxial port of a transmission line equipment box. An opposing end of the outer body 2000 includes a smooth outer cylindrical surface 2031 to form a press fit for mating with a protective cap 5000. If desired, outer cylindrical surface 2031 can be formed with external threads for mating with internal threads of the protective cap 5000. A pair of O-rings 2033 and 2035 may be used to form a fluid-tight seal between the outer body 2000 and a coaxial port threadably engaged with the external mounting threads 2029 and the protective cap 5000.

A center conductor contact 1000 extends through the central bore 2024 of the outer body 2000. The center conductor contact 1000 is supported at one end thereof by a first supporting insulator 1500. The first supporting insulator 1500 is in turn supported by an enlarged annular bore 2039 formed in the first end 2028 of the outer body 2000. The portion of the center conductor contact 1000 that protrudes outwardly from the first end 2028 of the outer body 2000 can be cut to any desired length by a user. A typical coaxial port of an equipment box includes a clamping mechanism for clamping the center conductor contact 1000 and establishing an electrical connection therewith.

The center conductor contact is also supported at its opposite end by a second supporting insulator 2500 of dielectric material which fits into central bore 2024 from the second end 2030 thereof. The outer diameter of the center conductor contact 1000 may be selected so that, at any point along its length, given the surrounding dielectric characteristics, and given the diameter of the surrounding inner wall, the characteristic impedance of center conductor contact 1000 will be matched with a desired characteristic impedance of the coaxial cable system (e.g., 75 ohms in a 75-ohm characteristic impedance system).

Figure 1A:
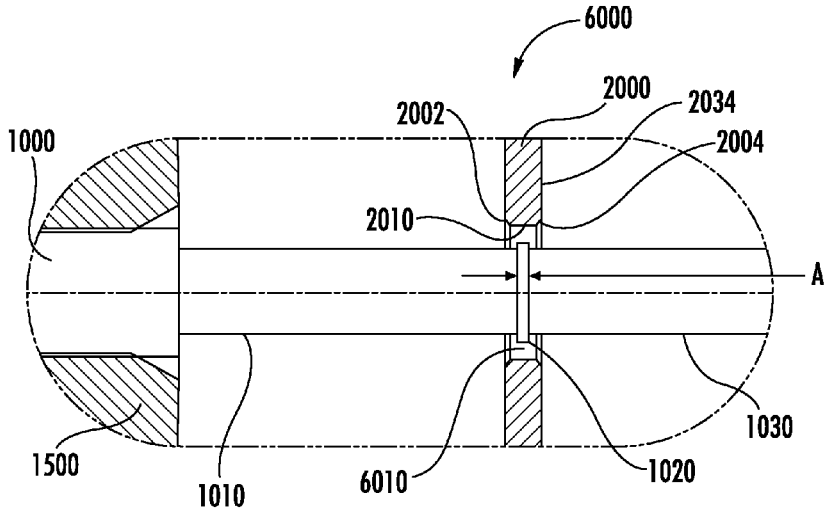
FIG. 1A PRIOR ART
FIG. 1A schematically depicts a detail partial cross-sectional view of a surge protected coaxial termination of FIG. 1.

Spark gap area 6000 is shown in greater detail in the enlarged drawing of FIG. 1A. As indicated in FIG. 1A, the center conductor 1000 includes a slightly enlarged diameter within radial step portion 2034 of inner wall 2032 to facilitate the jumping of a spark across spark gap 6010. The dimensions of the spark gap 6010 are selected to effectively insulate grounded radial step 2034 from center conductor 1000 at normal operating voltages and currents, up to a certain threshold voltage (for example, 1500 Volts). When the surge voltage between center conductor 1000 and outer body 2000 exceeds this threshold voltage, the spark gap 6010 will fire and conduct any excess energy to ground. Such an abnormal power surge might be induced by a lightning strike, for example.

The surge protected coaxial termination 10 also includes a resistive terminating element, resistor 3500, coupled between the center conductor 1000 and the grounded outer body 2000. Referring to FIG. 1, axial resistor 3500 is disposed within the central bore 2024 of the outer body 2000. The resistor 3500 is supported within the central bore 2046 of supporting insulator 2500. A first internal electrode 3502 of resistor 3500 is received within a bore 2049 formed in the end of center conductor 1000 that lies within supporting insulator 2500. The electrode may be soldered to center conductor 1000 before center conductor 1000 and resistor 3500 are inserted into supporting insulator 2500. At the opposite end of the resistor 3500, an external solder electrode 3504 protrudes from the outer face of supporting insulator 3000. The value for resistor 3500 is chosen to be compatible with the characteristic impedance of the coaxial line (e.g., 50 ohms, 75 ohms, etc.). The resistor 3500 is the element that absorbs the RF signal to prevent reflection. The resistor 3500 is preferably chosen to be a carbon composition resistor because such resistors offer good high frequency performance, and also have the ability to withstand the surge current that occurs as the capacitor is alternately charged, and then discharged, during surge protection. As mentioned above, any deviation from the characteristic impedance of the coaxial line can cause RF signal reflection; accordingly, the resistor 3500 is strategically placed on the central axis of the coaxial line structure, and surrounding supporting insulators 2500, 3000, and central bore 2024 of the outer body 2000, are designed to maintain the desired characteristic impedance throughout the length of resistor 3500.

A blocking capacitor 4000 in the form of a so-called "chip capacitor", extends radially between solder electrode 2048 and a second solder electrode 4500, or grounding post, that extends from a recess formed in outer body 2000. The opposing ends (electrodes) of the blocking capacitor 4000 are soldered to electrodes 2048 and post 4500 in order to electrically couple center conductor 1000 in series with the resistor 3500 and the capacitor 4000 to ground (outer body 2000), in parallel with spark gap 6010. Capacitor 4000 is provided to block DC or AC power from flowing through resistor 3500.

FIG. 1A is detail partial cross-sectional view of the surge protected coaxial termination of FIG. 1 including a spark gap area 6000, a center conductor contact 1000, and a body 2000. The center conductor contact 1000 includes a first cylindrical portion 1010, an enlarged diameter portion 1020 having an axial length "A" and a second cylindrical portion 1030. The body 2000 includes a first chamfer 2002, a second chamfer 2004, an orifice 2010 and the radial step 2034. The spark gap are includes a spark gap 6010.

Radial step 2034 of the body 2000 and spark gap 6010, being in close proximity to the center conductor 1000, represent a highly-capacitive discontinuity in the characteristic impedance of the transmission line relative to RF fields traveling therealong, and would normally cause the RF energy to be reflected, contrary to the purpose of the coaxial termination device. Accordingly, high characteristic impedance inductive zones are formed on both sides of reduced-diameter radial step 2034 to create the equivalent of an electrical T-network low pass filter. High impedance zones lie on opposite sides of radial step portion 2034. The amount of additional inductance introduced by high impedance inductive zones is offset the additional capacitance caused by reduced-diameter step portion 2034. The combined effect of such high impedance inductive zones together with the highly-capacitive radial step portion 2034, effectively nullifies the RF signal reflection that would otherwise occur due to radial step 2034 alone.

Figure 2:
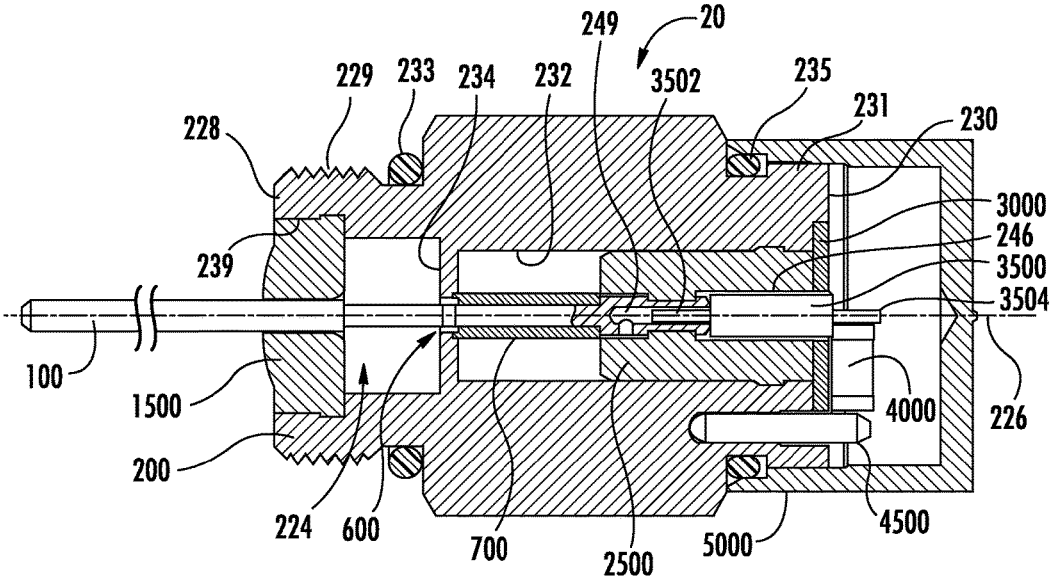
FIG. 2 schematically depicts a cross-sectional view of an example surge protected coaxial termination, according to one or more embodiments shown and described herein.

Referring now to FIG. 2, a cross-sectional view illustrates an example embodiment of a surge protected coaxial termination 20. The surge protected coaxial termination 20 comprises a metallic outer body 200. The body 200, for example, may incorporate a hex-shaped outer profile for receiving jaws of a wrench when the surge protected coaxial termination 20 is tightened onto a coaxial port of a transmission line equipment box. The metallic outer body 200 includes a central bore 224, or central passage, extending therethrough along a longitudinal axis 226 between a first end 228 and a second end 230 of the metallic outer body 200. The central bore 224 is defined by an inner wall 232. An inwardly-directed radial step 234 extends from the inner wall 232 toward the central axis 226. The step 234 is relatively short in the sense that its length along the central axis 226 is very short in comparison with the axial length of the remaining portion of the inner wall 232. Likewise, the inner diameter of the inner wall 232 within the step portion 234 is significantly smaller than the inner diameter of the remaining portion of the inner wall 232.

The first end 228 of the outer body includes external mounting threads 229 that may be used to secure the surge protected coaxial termination 20 to an unterminated coaxial port of a transmission line equipment box. An opposing end of the outer body 200 includes a smooth outer cylindrical surface 231 to form a press fit for mating with a protective cap 5000. If desired, outer cylindrical surface 231 can be formed with external threads for mating with internal threads of the protective cap 5000. A pair of O-rings 233 and 235 may be used to form a fluid-tight seal between the outer body 2000 and a coaxial port threadably engaged with the external mounting threads 229 and the protective cap 5000.

A center conductor contact 100 extends through the central bore 224 of the outer body 200. The center conductor contact 100 is supported at one end thereof by a first supporting insulator 1500. The first supporting insulator 1500 is in turn supported by an enlarged annular bore 239 formed in the first end 228 of the outer body 200. The portion of the center conductor contact 100 that protrudes outwardly from the first end 228 of the outer body 200 can be cut to any desired length by a user. A typical coaxial port of an equipment box includes a clamping mechanism for clamping the center conductor contact 100 and establishing an electrical connection therewith.

The center conductor contact 100 is also supported at its opposite end by a second supporting insulator 2500 of dielectric material which fits into central bore 224 from the second end 230 thereof. The outer diameter of the center conductor contact 100 may be selected so that, at any point along its length, given the surrounding dielectric characteristics, and given the diameter of the surrounding inner wall, the characteristic impedance of center conductor contact 100 will be matched with a desired characteristic impedance of the coaxial cable system (e.g., 75 ohms in a 75-ohm characteristic impedance system).

Figure 2A:
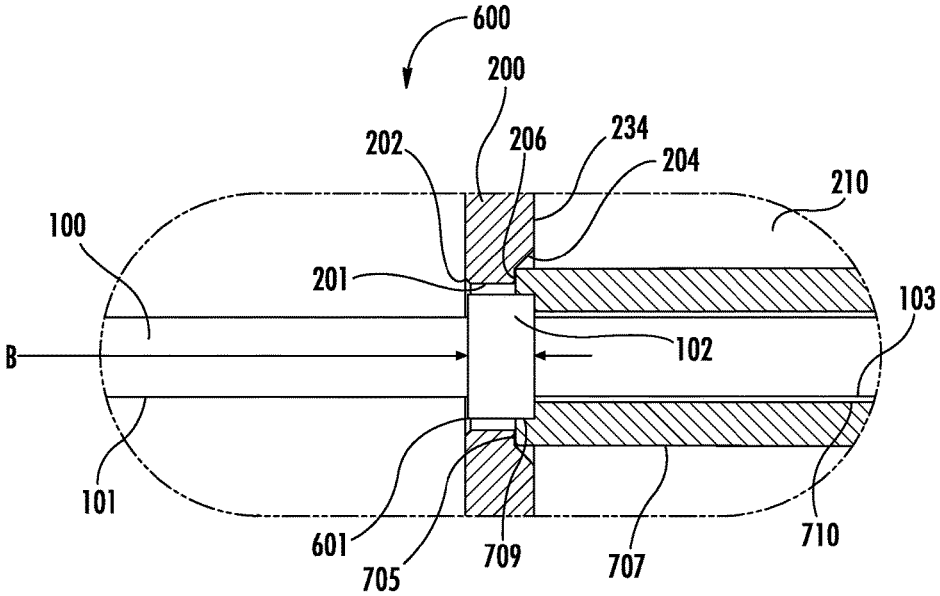
FIG. 2A schematically depicts a detail partial cross-sectional view of the surge protected coaxial termination of FIG. 2, according to one or more embodiments shown and described herein.

Spark gap area 600 is shown in greater detail in the enlarged drawing of FIG. 2A. As indicated in FIG. 2A, the center conductor 100 includes an enlarged diameter within radial step portion 234 of inner wall 232 to facilitate the jumping of a spark across spark gap 601. The dimensions of the spark gap 601 are selected to effectively insulate grounded radial step 234 from center conductor 100 at normal operating voltages and currents, up to a certain threshold voltage (for example, 1500 Volts). When the surge voltage between center conductor 100 and outer body 200 exceeds this threshold voltage, the spark gap 601 will fire and conduct any excess energy to ground. Such an abnormal power surge might be induced by a lightning strike, for example.

The surge protected coaxial termination 20 also includes a resistive terminating element, resistor 3500, coupled between the center conductor 100 and the grounded outer body 200. Referring to FIG. 2, axial resistor 3500 is disposed within the central bore 224 of the outer body 200. The resistor 3500 is supported within a central bore 246 of supporting insulator 2500. A first internal electrode 3502 of resistor 3500 is received within a bore 249 formed in the end of center conductor 100 that lies within supporting insulator 2500. The electrode 3502 may be soldered to center conductor 100 before center conductor 100 and resistor 3500 are inserted into supporting insulator 2500. At the opposite end of the resistor 3500, an external solder electrode 3504 protrudes from the outer face of supporting insulator 3000. The value for resistor 3500 is chosen to be compatible with the characteristic impedance of the coaxial line (e.g., 50 ohms, 75 ohms, etc.). The resistor 3500 is the element that absorbs the RF signal to prevent reflection. The resistor 3500 is preferably chosen to be a carbon composition resistor because such resistors offer good high frequency performance, and also have the ability to withstand the surge current that occurs as the capacitor is alternately charged, and then discharged, during surge protection. As mentioned above, any deviation from the characteristic impedance of the coaxial line can cause RF signal reflection; accordingly, the resistor 3500 is strategically placed on the central axis of the coaxial line structure, and surrounding supporting insulators 2500, 3000, and central bore 224 of the outer body 200, are designed to maintain the desired characteristic impedance throughout the length of resistor 3500.

A blocking capacitor 4000 in the form of a so-called "chip capacitor", extends radially between solder electrode 3504 and a second solder electrode 4500, or grounding post, that extends from a recess formed in outer body 200. The opposing ends (electrodes) of the blocking capacitor 4000 are soldered to electrodes 3504 and post 4500 in order to electrically couple center conductor 100 in series with the resistor 3500 and the capacitor 4000 to ground (outer body 200), in parallel with spark gap 601. Capacitor 4000 is provided to block DC or AC power from flowing through resistor 3500.

FIG. 2A depicts a detailed partial cross-sectional view of the surge protected coaxial termination 20 of FIG. 2. In this embodiment, the surge protected coaxial termination 20 includes a center conductor contact 100, a body 200, a spark gap area 600 and an insulator 700. The center conductor contact 100 includes a first forward cylindrical portion 101, a second enlarged central portion 102 having an axial length "B", and a third rearward cylindrical portion 103. The second enlarged central portion 102 is disposed generally at the spark gap 601, adjacent the inwardly-directed radial step 234 extending from the inner wall 232 of the body 200.

The body 200 also includes an orifice 201, a first forward chamfer 202 disposed at a radial inward portion of the radial step, adjacent the second enlarged central portion of the center conductor contact 102 and generally at the spark gap 601 of the spark gap area. A second chamfer 204 and a face 206 formed along a rearward side of the radial step 234 generally adjacent to the spark gap 601. The face 206 and second rearward facing chamfer of the radial step of the body 200 also support a front end 705 of the insulator 700. A cylindrical portion 707 extends within a bore 210 of the body in rearward direction away from the spark gap 601, radial step of the body and the second enlarged central portion 102 of the center conductor contact 100. The cylindrical portion 707 of the insulator 700 also surrounds, and thus insulates, the third rearward cylindrical portion 103 of the center conductor contact 100 within a passage 710 of the insulator 700 that extends in a rearward direction within the bore 210 extending away from the spark gap 601, radial step of the body and the second enlarged central portion 102 of the center conductor contact 100. The insulator 700 further comprises a counter bore 709 disposed at the front end 705 and adapted to receive and support the second enlarged portion 102 of the center conductor contact 100 adjacent to the spark gap.

An ability to withstand power surges in the surge protected coaxial termination 20 is enhanced by a relatively increased length B as compared to length A shown in FIG. 1A. As electrical arcs jump between the enlarged portion 102 and the orifice 201, the surface of enlarged portion 102 is eroded. As the surface of enlarged portion 102 is eroded the ability to shunt power to ground is decreased and Return Loss is somewhat negatively affected. An increased surface area of the enlarged portion 102 allows for a longer period of time before the ability to shunt power to ground is impacted, thereby increasing a length of time that the Return Loss performance remains stable even after multiple power surges required by the new specification previously noted. Additionally, the insulator 700 provides both improved centering of contact 100 within orifice 201 and protection from the breakdown of enlarged portion 102. The effect on electrical impedance of insulator 700 is offset by lengthening the bore 210 of body 200 in such a manner as to "tune" the RF structure of surge protected coaxial termination 20 to produce the desired Return Loss performance. In testing, a change in Return Loss as compared from a virgin state to the first arc was found to be relatively minor (on the order of approximately 2 dB) and remained relatively stable over the duration of the test thereafter.

Figure 3:
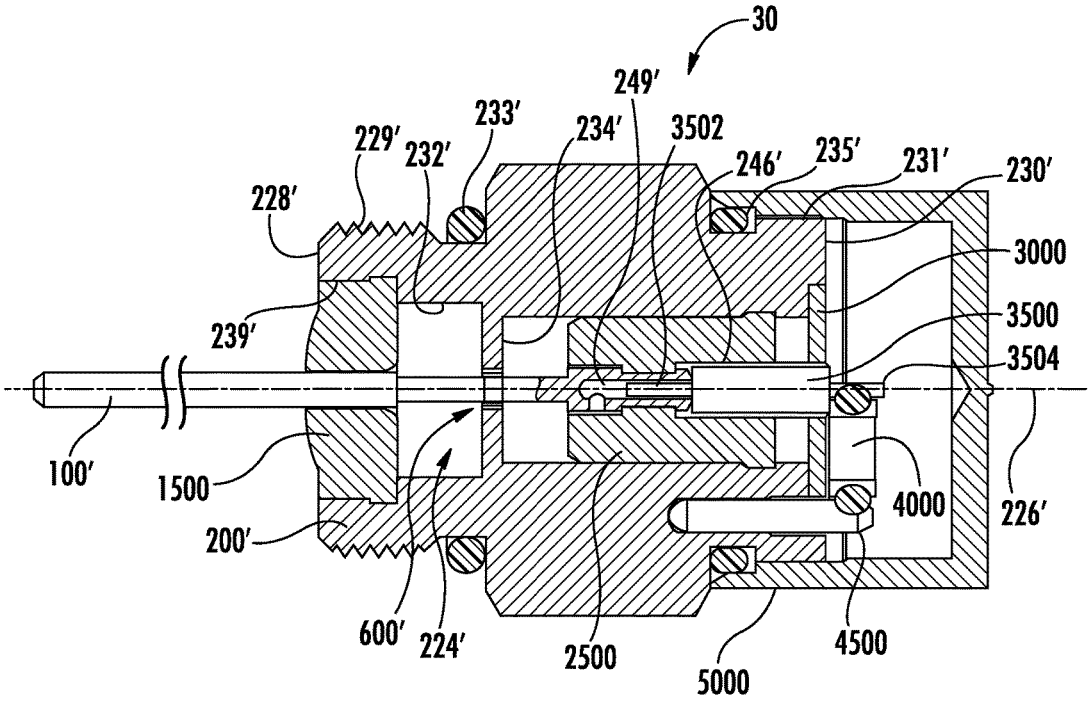
FIG. 3 schematically depicts a cross-sectional view of another example of a surge protected coaxial termination, according to one or more embodiments shown and described herein.

Referring now to FIG. 3, a cross-sectional view of another embodiment illustrating a surge protected coaxial termination 30. The surge protected coaxial termination 30 comprises a metallic outer body 200'. The metallic outer body 200 includes a central bore 224', or central passage, extending therethrough along a longitudinal axis 226' between a first end 220' and a second end 230' of the metallic outer body 200'. The central bore 224' is defined by an inner wall 232'. An inwardly-directed radial step 234 extends from the inner wall 232 toward the central axis 226'. The step 234' is relatively short in the sense that its length along the central axis 226' is very short in comparison with the axial length of the remaining portion of the inner wall 232'. Likewise, the inner diameter of the inner wall 232' within the step portion 234' is significantly smaller than the inner diameter of the remaining portion of the inner wall 232'.

A center conductor contact 100' extends through the central bore 224' of the outer body 200'. The center conductor contact 100' is supported at one end thereof by a first supporting insulator 1500. The first supporting insulator 1500 is in turn supported by an enlarged annular bore 239' formed in the first end 228' of the outer body 200'. The portion of the center conductor contact 100' that protrudes outwardly from the first end 228' of the outer body 200' can be cut to any desired length by a user. A typical coaxial port of an equipment box includes a clamping mechanism for clamping the center conductor contact 100' and establishing an electrical connection therewith.

The center conductor contact 100' is also supported at its opposite end by a second supporting insulator 2500 of dielectric material which fits into central bore 224' from the second end 230' thereof. The outer diameter of the center conductor contact 100 may be selected so that, at any point along its length, given the surrounding dielectric characteristics, and given the diameter of the surrounding inner wall, the characteristic impedance of center conductor contact 100' will be matched with a desired characteristic impedance of the coaxial cable system (e.g., 75 ohms in a 75-ohm characteristic impedance system).

Figure 3A:
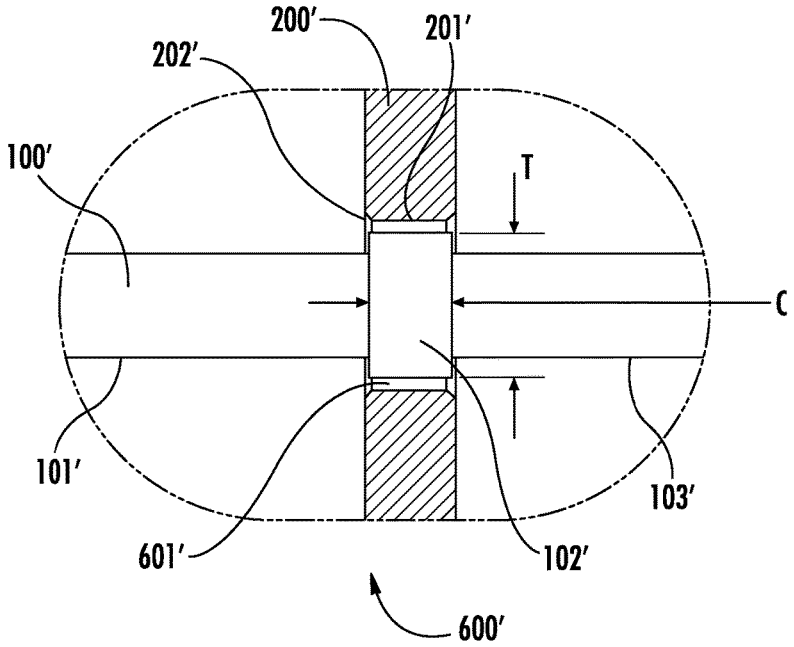
FIG. 3A schematically depicts a detail partial cross-sectional view of the surge protected coaxial termination of FIG. 3, according to one or more embodiments shown and described herein.

Spark gap area 600' is shown in greater detail in the enlarged drawing of FIG. 3A. As indicated in FIG. 3A, the center conductor 100' includes an enlarged diameter within radial step portion 234' of inner wall 232' to facilitate the jumping of a spark across spark gap 601'. The dimensions of the spark gap 601' are selected to effectively insulate grounded radial step 234' from center conductor 100' at normal operating voltages and currents, up to a certain threshold voltage (for example, 1500 Volts). When the surge voltage between center conductor 100' and outer body 200' exceeds this threshold voltage, the spark gap 601' will fire and conduct any excess energy to ground. Such an abnormal power surge might be induced by a lightning strike, for example.

The surge protected coaxial termination 20 also includes a resistive terminating element, resistor 3500, coupled between the center conductor 100 and the grounded outer body 200'. Referring to FIG. 3, axial resistor 3500 is disposed within the central bore 224' of the outer body 200'. The resistor 3500 is supported within a central bore 246' of supporting insulator 2500. A first internal electrode 3502 of resistor 3500 is received within a bore 249' formed in the end of center conductor 100' that lies within supporting insulator 2500. The electrode 3502 may be soldered to center conductor 100' before center conductor 100' and resistor 3500 are inserted into supporting insulator 2500. At the opposite end of the resistor 3500, an external solder electrode 3504 protrudes from the outer face of supporting insulator 3000. The value for resistor 3500 is chosen to be compatible with the characteristic impedance of the coaxial line (e.g., 50 ohms, 75 ohms, etc.). The resistor 3500 is the element that absorbs the RF signal to prevent reflection. The resistor 3500 is preferably chosen to be a carbon composition resistor because such resistors offer good high frequency performance, and also have the ability to withstand the surge current that occurs as the capacitor is alternately charged, and then discharged, during surge protection. As mentioned above, any deviation from the characteristic impedance of the coaxial line can cause RF signal reflection; accordingly, the resistor 3500 is strategically placed on the central axis of the coaxial line structure, and surrounding supporting insulators 2500, 3000, and central bore 224' of the outer body 200', are designed to maintain the desired characteristic impedance throughout the length of resistor 3500.

A blocking capacitor 4000 in the form of a so-called "chip capacitor", extends radially between solder electrode 3504 and a second solder electrode 4500, or grounding post, that extends from a recess formed in outer body 200'. The opposing ends (electrodes) of the blocking capacitor 4000 are soldered to electrodes 3504 and post 4500 in order to electrically couple center conductor 100' in series with the resistor 3500 and the capacitor 4000 to ground (outer body 200'), in parallel with spark gap 601'. Capacitor 4000 is provided to block DC or AC power from flowing through resistor 3500

Referring now to FIG. 3A, a detail partial cross-sectional view shows the surge protected coaxial termination 30 of FIG. 3. The surge protected coaxial termination includes a spark gap area 600', a contact 100', and a body 200'. The contact 100' includes a cylindrical portion 101', an enlarged portion 102' and a cylindrical portion 103'. The body 200' includes a chamfer 202', another chamfer 203, an orifice 201, and a spark gap 601'. It was discovered that this configuration actually continued to improve Return Loss performance (exhibiting inverse degradation) over a longer period of time as compared to FIG. 2. However, the change in Return Loss as compared from a virgin state to the first arc was greater than that seen in the configuration of FIG. 2.

Enlarged portion 102' has an axial length "C" and a diameter "T." The dimensions may vary depending on application. However, in one particular implementation, the enlarged portion 102' has an axial length "C" in a range from approximately 0.025" to approximately 0.06" and a diameter "T" in the range from approximately 0.05" to approximately 0.08". The enlarged portion 102' may also have a ratio of axial length to diameter from approximately 0.3 to 1 to approximately 1.3 to 1, and in some embodiments a ratio of axial length to diameter from approximately 0.5 to 1 to 1 to 1, and in still further embodiments from approximately 0.6 to 1 to approximately 1 to 1.

Figure 4:
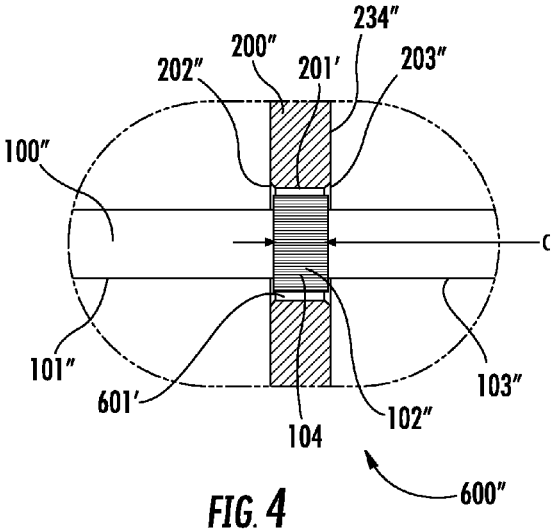
FIG. 4 schematically depicts a detail partial cross-sectional view of yet another example of a surge protected coaxial termination showing an enlarged portion of a contact, according to one or more embodiments shown and described herein.

Referring now to FIG. 4, a detail partial cross-sectional view illustrates yet another embodiment of a spark gap portion 600" of a surge protected coaxial termination. The spark gap portion 600" includes an enlarged portion 102" of a contact 100". The enlarged portion 102" is circumscribed with a plurality of raised ridges 104. In one embodiment, raised ridges 104 may be created by a process known in the industry as knurling. The raised ridges 104 create a plurality of arc points. The arc may concentrate at the areas where the spark gap is smallest and dissipate the center conductor material at that point leaving the next knurl peak to concentrate the arc blast during the next surge event, thus prolonging the life of the terminator over multiple arcing situations.

Figure 4A:
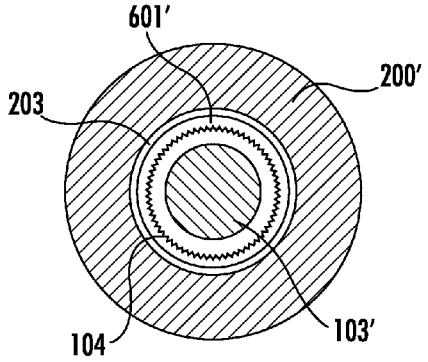
FIG. 4A schematically depicts a detail partial cross-sectional end view of the surge protected coaxial termination of FIG. 4, according to one or more embodiments shown and described herein.

FIG. 4A depicts a detail partial cross-sectional end view of the embodiment of FIG. 4 useful for illustrating the raised ridges 104 circumscribed on the enlarged portion 102".

Figure 5:
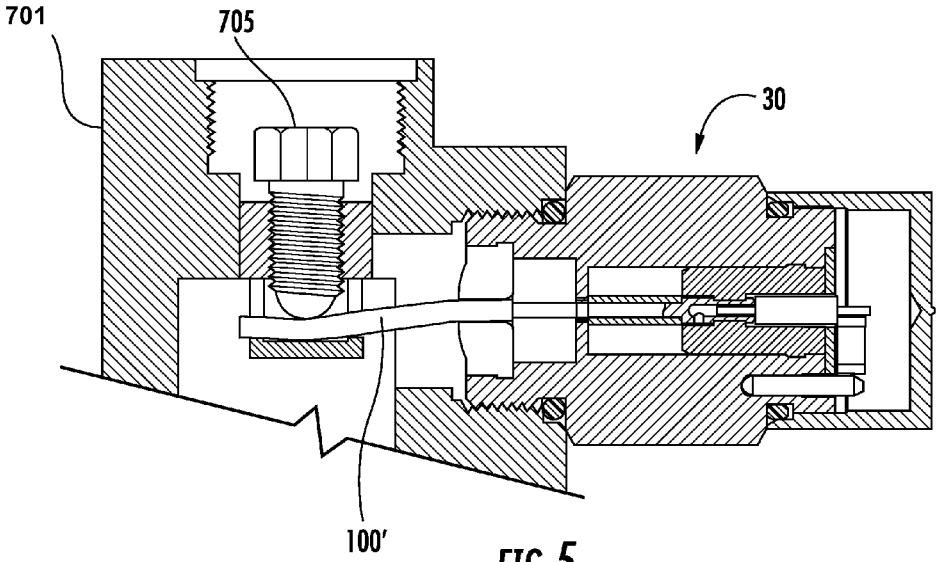
FIG. 5 schematically depicts a partial cross-sectional view of an example surge protected coaxial terminator mounted in a device, according to one or more embodiments shown and described herein.

Referring now to FIG. 5, the surge protected coaxial termination 30 shown in FIG. 3 is illustrated mounted in a device 701, such as an amplifier. In the embodiment shown in FIG. 5, the surge protected coaxial termination 30 includes a contact 100' mounted in the device 701 via a retaining screw 705 (shown fully tightened on contact 100' in FIG. 5). In extreme conditions of tightening the retaining screw 705 can bend the terminator center conductor 100' as shown in FIG. 5.

Figure 5A:
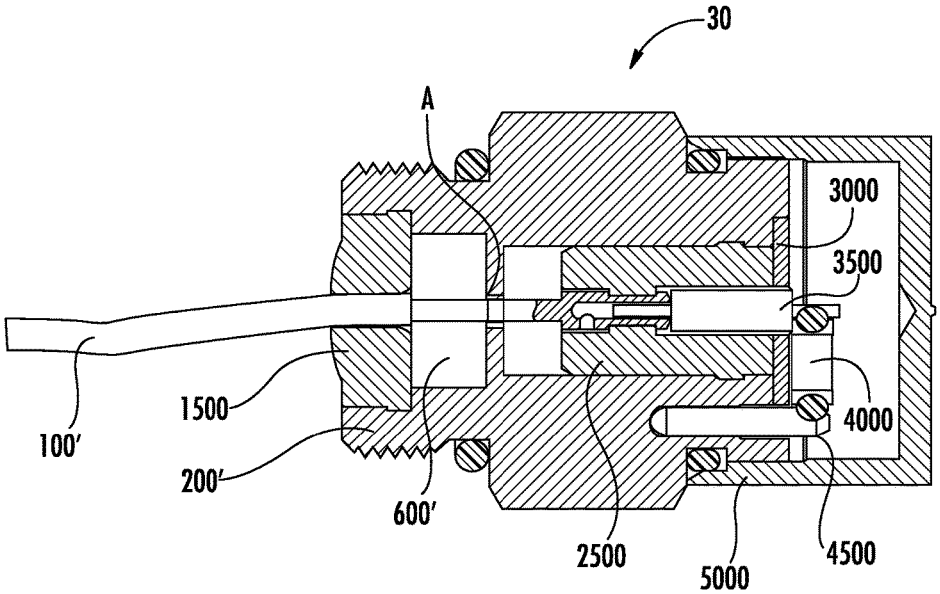
FIG. 5A schematically depicts a cross-sectional view an example surge protected coaxial terminator having a bent center conductor, according to one or more embodiments shown and described herein.

Referring now to FIG. 5A, the surge protected coaxial termination 30 of FIG. 5 is shown. In this implementation, the surge protected coaxial terminator 30 is shown having a bent center conductor 100' as described with reference to FIG. 5 causing distortion of the center conductor 100' such that it contacts the body 200' of the terminator 30 at or near point "A" causing an electrical short circuit.

Figure 5B:
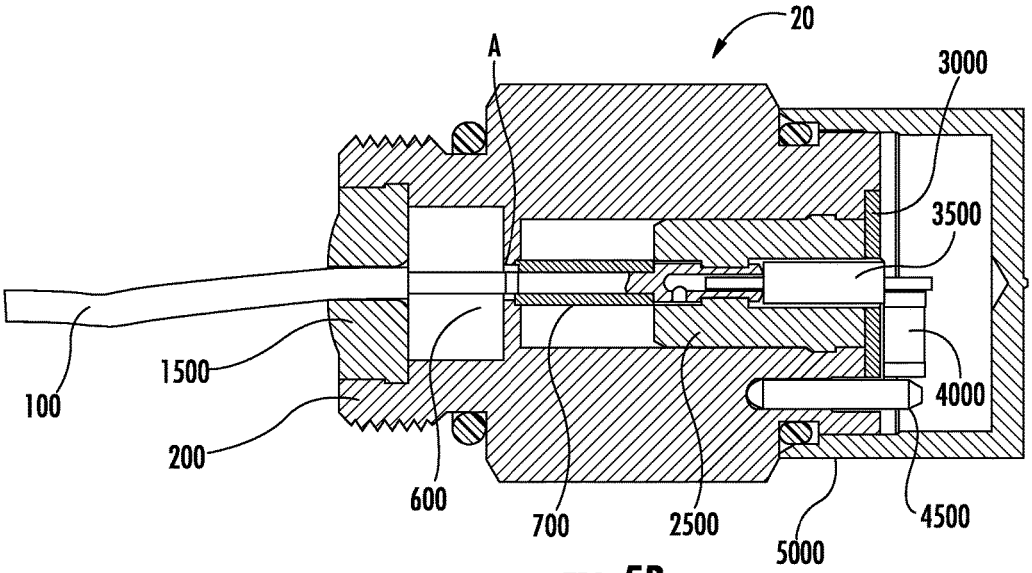
FIG. 5B schematically depicts a cross-sectional view of another example surge protected coaxial terminator having a bent center conductor, according to one or more embodiments shown and described herein.

FIG. 5B illustrates the surge protected coaxial termination 20 shown in FIG. 2 again having a bent center conductor 100. Again, the distortion of the center conductor 100 causes the center conductor 100 to contact the body 200 around point "A" shown in FIG. 5B causing an electrical short circuit.

Figure 6:
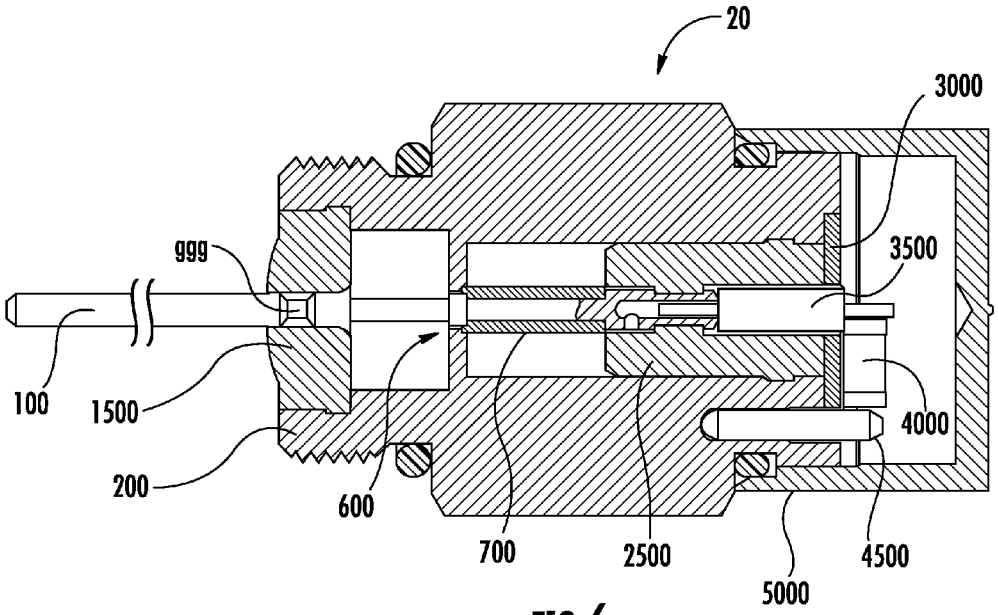
FIG. 6 schematically depicts a partial cross-sectional view of an example surge protected coaxial terminator including a groove in the center conductor that acts as a mechanical strain relief, according to one or more embodiments shown and described herein.

FIG. 6 shows another embodiment of a surge protected coaxial termination 20 including a structural feature ggg, such as a groove, a score or the like providing a mechanical strain relief portion to prevent distortion of the center conductor 100 occurring outside the terminator 20 from translating along the center conductor 100 to the point "A" shown in FIG. 5B.

Figure 7:
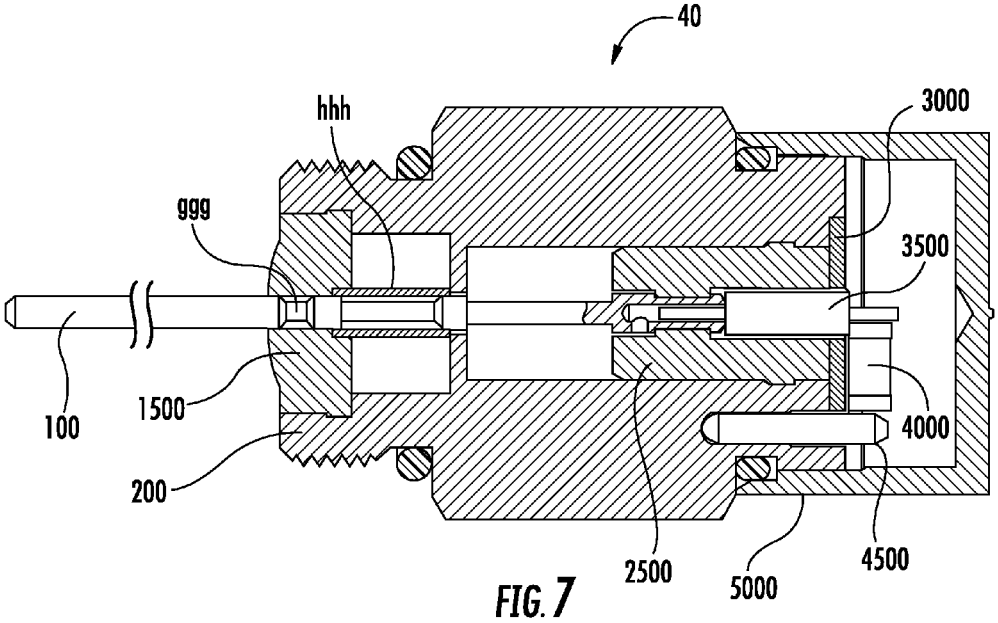
FIG. 7 schematically depicts a partial cross-sectional view of another example surge protected coaxial terminator including a groove in the center conductor that acts as a mechanical strain relief, according to one or more embodiments shown and described herein.

FIG. 7 shows yet another embodiment of a surge protected coaxial terminator 40 comprising a structural feature ggg, such as a groove, a score or the like, again providing a mechanical strain relief as described with reference to FIG. 6 to prevent distortion of the center conductor 100 from translating to the point "A" as illustrated in FIG. 5B and having an insulator hhh disposed forward of the spark gap area and engaging the insulator 1500 and body 200.

It should now be understood that embodiments described herein are directed to surge protected coaxial connectors. In particular, the surge protected coaxial connectors described herein may include at least one dielectric layer surrounding at least a portion of the central conductor adjacent to a spark gap. In other embodiments, an enlarged portion of the central conductor includes an increased axial length disposed within the spark gap. Furthermore, the embodiments described herein facilitate long term mechanical reliability of surge protected coaxial terminations.

For the purposes of describing and defining the subject matter of the disclosure it is noted that the term "substantially" is utilized herein to represent the inherent degree of uncertainty that may be attributed to any quantitative comparison, value, measurement, or other representation.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that any particular order be inferred.

It will be apparent to those skilled in the art that various modifications and variations can be made without departing from the spirit or scope of the disclosure. Since modifications, combinations, sub-combinations and variations of the disclosed embodiments incorporating the spirit and substance of the disclosure may occur to persons skilled in the art, the embodiments disclosed herein should be construed to include everything within the scope of the appended claims and their equivalents.

What is claimed is:

1. A surge-protected coaxial termination comprising:

a metallic outer body having a central bore extending therethrough along a longitudinal axis between first and second ends of the metallic outer body, the central bore being bounded by an inner wall having an inwardly-directed radial step extending into the central bore and defining, along with the inner wall:

a first portion of the central bore disposed on a first side of the radial step, a second orifice portion of the central bore disposed generally at the radial step, and a third portion of the central bore disposed on a second opposing side of the radial step;

a center conductor extending into the central bore of the metallic outer body and extending into each of the first, second and third portions of the central bore, the center conductor comprising:

a first cylindrical portion disposed at least partially within the first portion of the central bore, a second central portion disposed at least partially within the second orifice portion of the central bore in close proximity to the radial step of the body to form a spark gap therebetween, and a third cylindrical portion disposed at least partially within the third portion of the central bore, the third cylindrical portion of the center conductor at least partially surrounded by an insulator layer; and air within at least a portion of the spark gap formed between the radial step of the body and the second central portion of the center conductor.

2. The surge-protected coaxial termination of claim 1 wherein the wherein third cylindrical portion of the center conductor is disposed within a passage of the insulator layer for at least a portion of the third portion of the central bore.

3. The surge-protected coaxial termination of claim 1 wherein radial step comprises a face and a chamfer adapted to receive and support a longitudinal end of the insulator layer.

4. The surge-protected coaxial termination of claim 3 wherein the insulator layer at least partially reduces breakdown of the second central portion.

5. The surge-protected coaxial termination of claim 1 wherein the radial step comprises a chamfer adjacent the spark gap.

6. The surge-protected coaxial termination of claim 1 wherein the first side of the first portion of the radial step is disposed forward of the central portion of the central bore.

7. The surge-protected coaxial termination of claim 1 wherein the first side of the first portion of the radial step is disposed rearward of the central portion of the central bore.

8. The surge-protected coaxial termination of claim 1 wherein the air comprises an ionizing gas.

9. The surge-protected coaxial termination of claim 1 wherein an effect on termination electrical impedance due to the insulator layer is offset by a lengthening of the bore of the body to tune an RF structure of the termination.

10. The surge-protected coaxial termination of claim 1 wherein the first portion of the central bore has a first inner diameter the and a first axial length, the second orifice portion of the central bore also has a second inner diameter and a second axial length, wherein the second axial length is significantly shorter than the first axial length, and wherein the second inner diameter is significantly smaller than the first inner diameter.

11. The surge-protected coaxial termination of claim 10 wherein the second central portion of the center conductor has a predetermined outer diameter within the second orifice portion of the central bore, the predetermined outer diameter of the center conductor being slightly less than a second inner diameter of the second orifice portion defined by the radial step of the inner wall for positioning the second portion of the inner wall in close proximity to the center conductor to form a spark gap therebetween.

12. The surge-protected coaxial termination of claim 1 wherein the center conductor is comprises a structural mechanical strain relief feature disposed forward of the spark gap.

13. The surge-protected coaxial termination of claim 12 wherein the structural mechanical strain relief feature comprises a groove or a score in the center conductor.

14. The surge-protected coaxial termination of claim 12 wherein the structural mechanical strain relief feature is disposed within a supporting insulator disposed within an annular bore in the body disposed at a front end of the termination.

15. The A-surge-protected coaxial termination of claim 1 wherein the second central portion of the center conductor has an axial length and a diameter, and a ratio of the axial length to the diameter of the second central portion is in a range from approximately 0.3 to 1 to approximately 1.3 to 1.

16. The surge-protected coaxial termination of claim 15 wherein the radial step comprises a chamfer adjacent the spark gap.

17. The surge-protected coaxial termination of claim 15 wherein the air comprises an ionizing gas.

18. The surge-protected coaxial termination of claim 15 wherein the first portion of the central bore has a first inner diameter and a first axial length, the second orifice portion of the central bore also has a second inner diameter and a second axial length, wherein the second axial length is significantly shorter than the first axial length, and wherein the second inner diameter is significantly smaller than the first inner diameter.

19. The surge-protected coaxial termination of claim 18 wherein the second central portion of the center conductor has a predetermined outer diameter within the second orifice portion of the central bore, the predetermined outer diameter of the center conductor being slightly less than a second inner diameter of the second orifice portion defined by the radial step of inner wall for positioning the second portion of the inner wall in close proximity to the center conductor to form the spark gap therebetween.

20. The surge-protected coaxial termination of claim 15 wherein the center conductor is comprises a structural mechanical strain relief feature disposed forward of the spark gap.

21. The surge-protected coaxial termination of claim 20 wherein the structural mechanical strain relief feature comprises a groove or a score in the center conductor.

22. The surge-protected coaxial termination of claim 20 wherein the structural mechanical strain relief feature is disposed within a supporting insulator disposed within an enlarged annular bore in the body disposed at a front end of the termination.

23. The surge-protected coaxial termination of claim 15 wherein the ratio of the axial length to the diameter of the second enlarged central portion is in a range from approximately 0.5 to 1 to approximately 1 to 1.

* * * * *